US012428818B2

(12) United States Patent
Malegam et al.

(10) Patent No.: US 12,428,818 B2
(45) Date of Patent: Sep. 30, 2025

(54) OBJECT PROXIMITY DETECTION AND FEEDBACK SYSTEM FOR A MINING MACHINE

(71) Applicant: Joy Global Surface Mining Inc, Milwaukee, WI (US)

(72) Inventors: Keshad D. Malegam, Milwaukee, WI (US); Wesley P. Taylor, New Berlin, WI (US); Matthew Reiland, Mequon, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 937 days.

(21) Appl. No.: 17/500,772

(22) Filed: Oct. 13, 2021

(65) Prior Publication Data

US 2022/0112690 A1 Apr. 14, 2022

Related U.S. Application Data

(60) Provisional application No. 63/090,899, filed on Oct. 13, 2020.

(51) Int. Cl.
*E02F 9/24* (2006.01)
*E21C 35/00* (2006.01)
(Continued)

(52) U.S. Cl.
CPC ..... *E02F 9/24* (2013.01); *E21C 35/04* (2013.01); *E21C 35/282* (2023.05); *E21C 35/302* (2023.05); *E21B 7/02* (2013.01)

(58) Field of Classification Search
CPC ..... B60Q 9/008; B60Q 5/006; B66C 13/46; B66C 15/04
See application file for complete search history.

(56) References Cited

U.S. PATENT DOCUMENTS 6,140,930 A 10/2000 Shaw
6,549,139 B2 4/2003 Shaw, Jr.
(Continued)

FOREIGN PATENT DOCUMENTS

AU 2020201817 A1 4/2020
EP 0965114 A1 12/1999
(Continued)

OTHER PUBLICATIONS

International Search Report and Written Opinion for Application No. PCT/US2021/54830 dated Jan. 24, 2022 (16 pages).
(Continued)

*Primary Examiner* — Benyam Haile
(74) *Attorney, Agent, or Firm* — Husch Blackwell LLP

(57) ABSTRACT

A system for detecting a potential collision between an object and a mining machine, the system comprising: a sensor, a first strobe light and a second strobe light, and an electronic processor configured to identify a virtual perimeter around at least a portion of the mining machine, identify a plurality of collision zones, the plurality of collision zones including at least one immediate collision zone and at least one potential collision zone, receive a signal from a sensor indicating detection of the object in one of the plurality of collision zones, determine, based on the signal, whether the object is in the immediate collision zone or the potential collision zone, generate, in response to determining that the object is in the potential collision zone, a first indication, and generate, in response to determining that the object is in the immediate collision zone, a second indication different than the first indication.

20 Claims, 21 Drawing Sheets

(51) Int. Cl.
*E21C 35/04* (2006.01)
*E21B 7/02* (2006.01)

(56) References Cited

U.S. PATENT DOCUMENTS

| | | | | |
|---|---|---|---|---|
| 6,744,372 | B1 | 6/2004 | Shaw et al. | |
| 6,894,621 | B2 | 5/2005 | Shaw | |
| 8,248,263 | B2 | 8/2012 | Shervey et al. | |
| 8,350,714 | B2 | 1/2013 | Trim | |
| 8,477,021 | B2 | 7/2013 | Slack | |
| 8,707,595 | B2 | 4/2014 | Beemsterboer et al. | |
| 8,872,643 | B2 | 10/2014 | Ebert | |
| 8,885,559 | B2 | 11/2014 | Schmidt et al. | |
| 9,030,332 | B2 | 5/2015 | Tafazoli et al. | |
| 9,258,722 | B2 | 2/2016 | Schmidt et al. | |
| 9,269,255 | B2 | 2/2016 | Beaulieu et al. | |
| 9,500,079 | B2 | 11/2016 | Makela | |
| 9,747,802 | B2 | 8/2017 | Fisher et al. | |
| 9,787,951 | B2 | 10/2017 | Kannon et al. | |
| 10,046,699 | B2 | 8/2018 | Hathaway et al. | |
| 10,099,609 | B2 | 10/2018 | Pagliani et al. | |
| 10,170,000 | B2 | 1/2019 | Frederick et al. | |
| 10,482,729 | B2 | 11/2019 | Tonello | |
| 2006/0087443 | A1 | 4/2006 | Frederick et al. | |
| 2009/0109049 | A1* | 4/2009 | Frederick | F16P 3/147 340/686.6 |
| 2017/0086377 | A1 | 3/2017 | Jongmans et al. | |
| 2019/0145577 | A1 | 5/2019 | Blenkinsopp et al. | |
| 2020/0096627 | A1* | 3/2020 | Taylor | G01S 13/931 |

FOREIGN PATENT DOCUMENTS

| | | | |
|---|---|---|---|
| WO | 9838612 | A1 | 9/1998 |
| WO | 2006079165 | A1 | 8/2006 |
| WO | 2010107440 | A1 | 9/2010 |
| WO | 2017106802 | A1 | 6/2017 |
| WO | 2019105583 | A1 | 6/2019 |

OTHER PUBLICATIONS

Glynn, "Collision Avoidance Systems for Mine Haul Trucks and Unambiguous Dynamic Real Time Single Object Detection," <https://research-repository.griffith.edu.au/bitstream/handle/10072/365488/Glynn_2005_01Thesis.pdf?sequence=1> published 2005, 240 pages.

Schiffbauer, "An Active Proximity Warning System for Surface and Underground Mining Applications" <https://www.researchgate.net/publication/237666905_AN_ACTIVE_PROXIMITY_WARNING_SYSTEM_FOR_SURFACE_AND_UNDERGROUND_MINING_APPLICATIONS/citation/download> published Dec. 2002, 8 pages.

Canadian Examiner's Report for Application No. 3,173,232, dated Feb. 2024, 10 pages.

Canadian Examiner's Report for Application No. 3,173,232, dated Nov. 4, 2024, 10 pages.

Chilean Substantive Report for Application No. 202301067, dated Dec. 2, 2024.

* cited by examiner

OBJECT PROXIMITY DETECTION AND FEEDBACK SYSTEM FOR A MINING MACHINE

CROSS-REFERENCE TO RELATED APPLICATIONS

The present application is a continuation of U.S. patent application Ser. No. 63/090,899, filed on Oct. 13, 2020, the entire contents of which are incorporated by reference herein.

FIELD

Embodiments described herein relate to an object proximity detection and feedback system for a mining machine.

SUMMARY

Autonomous mining machines or semi-automated mining machines include various external sensors or detectors that are important to such machines being able to perform their designated functions. People working in proximity to such vehicles have limited knowledge of what the vehicle is sensing or doing with respect to the peoples' actions. Proximity detection systems ("PDS") or obstacle detection systems ("ODS") do not typically provide any form of feedback to off-board personnel. Indications of such systems detecting an object may be provided to a remote or local operator of the mining machine, but no indication is provided externally. Some autonomous machines do utilize stack lights to provide basic operational feedback (i.e., operational state of the mining machine), but that feedback is limited and ambient (e.g., not targeted).

Embodiments described here in provide a system for detecting a potential collision between an object and a mining machine, the system comprising: a sensor, a first strobe light and a second strobe light, and an electronic processor configured to identify a virtual perimeter around at least a portion of the mining machine, identify a plurality of collision zones, the plurality of collision zones including at least one immediate collision zone and at least one potential collision zone, receive a signal from a sensor indicating detection of the object in one of the plurality of collision zones, determine, based on the signal, whether the object is in the immediate collision zone or the potential collision zone, generate, in response to determining that the object is in the potential collision zone, a first indication, and generate, in response to determining that the object is in the immediate collision zone, a second indication different than the first indication.

Embodiments described here in provide a method for detecting a collision risk between an object and a mining machine, the method comprising: identifying, by an electronic processor, a virtual perimeter around at least a portion of the mining machine; identifying, by the electronic processor, a plurality of collision zones, the plurality of collision zones including at least one immediate collision zone and at least one potential collision zone; receiving, by the electronic processor, a signal from a sensor indicating detection of the object in one of the plurality of collision zones; determining, by the electronic processor, based on the signal, whether the object is in the immediate collision zone or the potential collision zone; in response to determining that the object is in the potential collision zone, generating, by the electronic processor, a first indication; and in response to determining that the object is in the immediate collision zone, generating, by the electronic processor, a second indication different than the first indication.

Embodiments described here in provide a system for detecting an object within a vicinity of a mining machine, the system comprising: a sensor configured to secure to the mining machine; a first plurality of light sources configured to secure to the mining machine; and an electronic processor configured to: receive a signal from the sensor indicative of the object being positioned in the vicinity of the mining machine, determine that the position of the object corresponds to a first segment of a virtual perimeter extending at least partially around the mining machine, the first segment associated with the first plurality of light sources, identify a first light source of the first plurality of light sources that is closest to the object, control the first light source to repeatedly flash, and control a second light source of the first plurality of light sources to illuminate in a different manner than the first light source.

Embodiments described here in provide a method for detecting an object within a vicinity of a mining machine, the method comprising: receiving, by an electronic processor, a signal from a sensor indicative of the object being positioned in the vicinity of the mining machine; determining, by the electronic processor, that the position of the object corresponds to a first segment of a virtual perimeter extending at least partially around the mining machine, the first segment associated with the first plurality of light sources; identifying, by the electronic processor, a first light source of the first plurality of light sources that is closest to the object; controlling, by the electronic processor, the first light source to repeatedly flash; and controlling, by the electronic processor, a second light source of the first plurality of light sources to illuminate in a different manner than the first light source.

Embodiments described herein provide visual or optical feedback around the perimeter of a mining machine. A PDS for the mining machine is configured to monitor for objects in proximity to the mining machine. The PDS is configured to control the operation of the mining machine in a safe manner to avoid collisions or inhibited motion. A controller for the mining machine is configured to receive signals from sensors that are included in the PDS. The controller is also configured to receive one or more outputs of the PDS related to, for example, a location of an object, a proximity of the object, and/or an object type. The controller is configured to generate optical feedback in the direction of the object detected by the PDS. Depending upon, for example, the location of the object and the proximity of the object, the controller is configured to generate one or more control signals to control a subset of a plurality of lights. The subset of the plurality of lights are controlled to provide directed feedback to the object to indicate that the PDS has detected the presence of the object. As a result, for example, maintenance personnel are able to approach the mining machine and be confident that the PDS has detected their presence, is tracking their movements, and will react appropriately to their presence. Absent such feedback, it could be dangerous for a person or a vehicle to approach the mining machine.

Embodiments described herein provide a mining machine, such as a blasthole drill, rope shovel, or the like, that includes one or more indicators mounted to an external portion of the mining machine. The one or more indicators are configured to provide an indication to an individual external to the mining machine that a proximity detection system has detected the individual's presence external to the mining machine.

In one embodiment, a method is provided for detecting an object within a vicinity of a mining machine and providing visual feedback. The method includes determining, by an electronic processor, a position of the object in the vicinity of the mining machine based on a first output from a proximity sensor of the mining machine. The electronic processor further determines that the position of the object corresponds to a first segment of a perimeter of the mining machine, where the first segment is associated with a first plurality of light sources. The electronic processor further determines a first light source of the first plurality of light sources that is closest to the object using the position of the object. The method further includes controlling, by the electronic processor, the first light source of the first plurality of light sources to repeatedly flash in response to determining that the first light source of the first plurality of light sources is closest to the object; and controlling, by the electronic processor, at least one other light source of the first plurality of light sources to illuminate in a different manner than the first light source of the first plurality of light sources, wherein controlling the at least one other light source is in response to determining that the position of the object corresponds to the first segment.

In some embodiments, the method further includes determining, by the electronic processor, that the position of the object is between respective perpendicular lines extending away from the mining machine from two end points that define the first segment. In some embodiments, the first segment is one segment of a plurality of segments defined by the perimeter of the mining machine. In some embodiments, the first light source of the first plurality of light sources repeatedly flashes at a flash rate determined based on a distance between the object and the first machine segment. In some embodiments, the object that is detected is a first object, and the method further includes: determining, by the electronic processor, a position of a second object in the vicinity of the mining machine while the first object is detected in the vicinity of the mining machine based on a second output from the proximity sensor of the mining machine; determining, by the electronic processor, that the position of the second object corresponds to the first segment of the perimeter of the mining machine; determining, by the electronic processor, that the first light source is a light source of the first plurality of lights sources that is closest to the second object; determining, by the electronic processor, which of the first object and the second object is a closer object to the mining machine based on the position of the first object and the position of the second object; controlling, by the electronic processor, the first light source of the first plurality of light sources to repeatedly flash based on a distance of the closer object to the first segment; and controlling, by the electronic processor, the at least one other light source of the first plurality of light sources to illuminate in a different manner than the first light source of the first plurality of light sources. In some embodiments, the object that is detected is a first object, and the method further includes: determining, by the electronic processor, a position of a second object in the vicinity of the mining machine while the first object is detected in the vicinity of the mining machine based on a second output from the proximity sensor of the mining machine; determining, by the electronic processor, that the position of the second object corresponds to the first segment of the perimeter of the mining machine; determining, by the electronic processor, that a second light source of the first plurality of light sources is closest to the second object using the position of the second object; controlling, by the electronic processor, the second light source of the first plurality of light sources to repeatedly flash based on a distance of the second object to the first segment, while continuing to control the first light source to repeatedly flash based on the distance of the first object to the first segment; and controlling, by the electronic processor, the at least one other light source of the first plurality of light sources to illuminate in a different manner than the second light source of the first plurality of light sources. In some embodiments, the method further includes: determining, by the electronic processor, a position of a second object in the vicinity of the mining machine based on a second output from the proximity sensor of the mining machine; determining, by the electronic processor, that the position of the second object corresponds to a second segment of the perimeter of the mining machine, the second segment associated with a second plurality of light sources; determining, by the electronic processor, a first light source of the second plurality of light sources that is closest to the second object using the position of the second object; controlling, by the electronic processor, the first light source of the second plurality of light sources to repeatedly flash in response to determining that the first light source of the second plurality of light sources is closest to the second object; and controlling, by the electronic processor, at least one other light source of the second plurality of light sources to illuminate in a different manner than the first light source of the second plurality of light sources, wherein controlling the at least one other light source of the second plurality of lights sources is in response to determining that the position of the second object corresponds to the second segment. In some embodiments, the controlling of the first light source of the first plurality of light sources and the controlling of the at least one other light source of the first plurality of light sources occurs simultaneously with the controlling of the first light source of the second plurality of lights sources and the controlling of the at least one other light source of the second plurality of lights sources. In some embodiments, the controlling, by the electronic processor, of the at least one other light source of the first plurality of light sources to illuminate in a different manner than the first light source of the first plurality of light sources includes controlling all other light sources of the first plurality of light sources to illuminate in a different manner than the first light source of the first plurality of light sources. In some embodiments, the controlling, by the electronic processor, of the at least one other light source of the first plurality of light sources to illuminate in a different manner than the first light source of the first plurality of light sources includes controlling the at least one other light source of the first plurality of light sources to illuminate in a steady on manner.

In another embodiment, a system is provided for detecting an object within a vicinity of a mining machine. The system includes a proximity sensor of the mining machine configured to secure to the mining machine; a first plurality of light sources configured to secure to the mining machine; and an electronic processor. The electronic processor is configured to: determine a position of the object in the vicinity of the mining machine based on a first output from the proximity sensor of the mining machine; and determine that the position of the object corresponds to a first segment of a perimeter of the mining machine, where the first segment associated with the first plurality of light sources. The electronic processor is further configured to, in response to determining that the position of the object corresponds to the first segment: determine a first light source of the first plurality of light sources that is closest to the object using the position of the object; control the first light source of the first plurality of light sources to repeatedly flash; and control at least one other light source of the first plurality of light sources to illuminate in a different manner than the first light source of the first plurality of light sources.

In some embodiments, the proximity sensor, the first plurality of light sources, and the electronic processor are secured to the mining machine, and the mining machine is one of a rope shovel and a blasthole drill. In some embodiments, the electronic processor is further configured to determine that the position of the object is between respective perpendicular lines extending away from the mining machine from two end points that define the first segment, wherein the first segment is one segment of a plurality of segments, the plurality of segments defining the perimeter of the mining machine. In some embodiments, the first light source of the first plurality of light sources repeatedly flashes at a flash rate determined based on a distance between the object and the first segment. In some embodiments, the object that is detected is a first object and the electronic processor is further configured to: determine a position of a second object in the vicinity of the mining machine while the first object is detected in the vicinity of the mining machine based on a second output from the proximity sensor of the mining machine; determine that the position of the second object corresponds to the first segment of the perimeter of the mining machine; determine that the first light source is a light source of the first plurality of lights sources that is closest to the second object; determine which of the first object and the second object is a closer object to the mining machine based on the position of the first object and the position of the second object; control the first light source of the first plurality of light sources to repeatedly flash based on a distance of the closer object to the first segment; and control the at least one other light source of the first plurality of light sources to illuminate in a different manner than the first light source of the first plurality of light sources. In some embodiments, the object that is detected is a first object and the electronic processor is further configured to: determine a position of a second object in the vicinity of the mining machine while the first object is detected in the vicinity of the mining machine based on a second output from the proximity sensor of the mining machine; determine that the position of the second object corresponds to the first segment of the perimeter of the mining machine; determine that a second light source of the first plurality of light sources is closest to the second object using the position of the second object; control the second light source of the first plurality of light sources to repeatedly flash based on a distance of the second object to the first segment, while continuing to control the first light source to repeatedly flash based on the distance of the first object to the first segment; and control the at least one other light source of the first plurality of light sources to illuminate in a different manner than the second light source of the first plurality of light sources. In some embodiments, the system further includes a second plurality of light sources configured to secure to the mining machine, and the electronic processor is further configured to: determine a position of a second object in the vicinity of the mining machine based on a second output from the proximity sensor of the mining machine; determine that the position of the second object corresponds to a second segment of the perimeter of the mining machine, the second segment associated with the second plurality of light sources; determine a first light source of the second plurality of light sources that is closest to the second object using the position of the second object; control the first light source of the second plurality of light sources to repeatedly flash in response to determining that the first light source of the second plurality of light sources is closest to the second object; and control at least one other light source of the second plurality of light sources to illuminate in a different manner than the first light source of the second plurality of light sources, wherein controlling the at least one other light source of the second plurality of lights sources is in response to determining that the position of the second object corresponds to the second segment. In some embodiments, the controlling of the first light source of the first plurality of light sources and the controlling of the at least one other light source of the first plurality of light sources occurs simultaneously with the controlling of the first light source of the second plurality of lights sources and the controlling of the at least one other light source of the second plurality of lights sources. In some embodiments, the electronic processor is further configured to control the at least one other light source of the first plurality of light sources to illuminate in a different manner than the first light source of the first plurality of light sources includes controlling all other light sources of the first plurality of light sources to illuminate in a different manner than the first light source of the first plurality of light sources. In some embodiments, the electronic processor is further configured to control the at least one other light source of the first plurality of light sources to illuminate in a different manner than the first light source of the first plurality of light sources includes controlling the at least one other light source of the first plurality of light sources to illuminate in a steady on manner.

In another embodiment, a method is provided for detecting a potential collision between an object and a mining machine. The method includes determining, by an electronic processor of a mining machine, a virtual perimeter of the mining machine defined by a plurality of segments; and receiving, by the electronic processor, a signal from a proximity sensor indicating detection of an object in a vicinity of the mining machine. The method further includes determining, by the electronic processor, based on the signal, whether the object is in a collision zone selected from a group of a plurality of a potential collision zones external to the virtual perimeter and a plurality of immediate collision zones external to the virtual perimeter. The method further includes in response to determining that the object is in a first potential collision zone of the potential collision zones based on the signal, illuminating strobe lights associated with the first potential collision zone including at least a first strobe light along a first segment of the plurality of segments and a second strobe light along a second segment of the plurality of segments.

In some embodiments, each segment of the plurality of segments is a straight line connecting two consecutive points of a plurality of machine perimeter points. In some embodiments, each of the immediate collision zones is located adjacent to a respective segment of the virtual perimeter. In some embodiments, each of the potential collision zones adjoins at least two of the immediate collision zones. In some embodiments, each of the potential collision zones adjoins at least two of the immediate collision zones or at least two other potential collision zones of the potential collision zones. In some embodiments, determining, by the electronic processor, whether the object is in the collision zone includes: determining, with the electronic processor, a plurality of virtual triangles defined by a reference point of the mining machine and endpoints of each respective segment of the plurality of segments. In some embodiments, the object is determined to be in one of the potential collision zones based upon (i) a first object virtual triangle, defined by an object location and the first segment of the plurality of segments, not intersecting the plurality of virtual triangles, and (ii) a second object virtual triangle, defined by the object location and the second segment of the plurality of segments, not intersecting the plurality of virtual triangles. In some embodiments, the first strobe light and the second strobe light are associated with two immediate collision zones adjoining the potential collision zone. In some embodiments, the virtual perimeter is polygonal. In some embodiments, the method further includes: in response to determining that the object is in a first immediate collision zone of the immediate collision zones, where the first immediate collision zone is associated with the first segment, illuminating at least the first strobe light along the first segment.

In another embodiments, a system is provided for detecting a potential collision between an object and a mining machine. The system includes a proximity sensor, a first strobe light and a second strobe light, and an electronic processor. The electronic processor is configured to: determine a virtual perimeter of the mining machine defined by a plurality of segments; receive a signal from the proximity sensor indicating detection of an object in a vicinity of the mining machine; determining, by the electronic processor, based on the signal, whether the object is in a collision zone selected from a group of a plurality of a potential collision zones external to the virtual perimeter and a plurality of immediate collision zones external to the virtual perimeter; and in response to determining that the object is a first potential collision zone of the potential collision zones based on the signal, illuminating strobe lights associated with the first potential collision zone including at least the first strobe light along a first segment of the plurality of segments and the second strobe light along a second segment of the plurality of segments.

In some embodiments, each segment of the plurality of segments is a straight line connecting two consecutive points of a plurality of machine perimeter points. In some embodiments, each of the immediate collision zones is located adjacent to a respective segment of the virtual perimeter. In some embodiments, each of the potential collision zones adjoins at least two of the immediate collision zones. In some embodiments, each of the potential collision zones adjoins at least two of the immediate collision zones or at least two other potential collision zones of the potential collision zones. In some embodiments, to determine whether the object is in the collision zone, the electronic processor is further configured to determine a plurality of virtual triangles defined by a reference point of the mining machine and endpoints of each respective segment of the plurality of segments. In some embodiments, the object is determined to be in one of the potential collision zones based upon (i) a first object virtual triangle, defined by an object location and the first segment of the plurality of segments, not intersecting the plurality of virtual triangles, and (ii) a second object virtual triangle, defined by the object location and the second segment of the plurality of segments, not intersecting the plurality of virtual triangles. In some embodiments, the first strobe light and the second strobe light are associated with two immediate collision zones adjoining the potential collision zone. In some embodiments, the virtual perimeter is polygonal. In some embodiments, the electronic processor is further configured to: illuminate at least the first strobe light along the first segment in response to determining that the object is in a first immediate collision zone of the immediate collision zones, where the first immediate collision zone is associated with the first segment.

Other aspects of the embodiments will become apparent by consideration of the detailed description and accompanying drawings.

DETAILED DESCRIPTION

Figure 1:
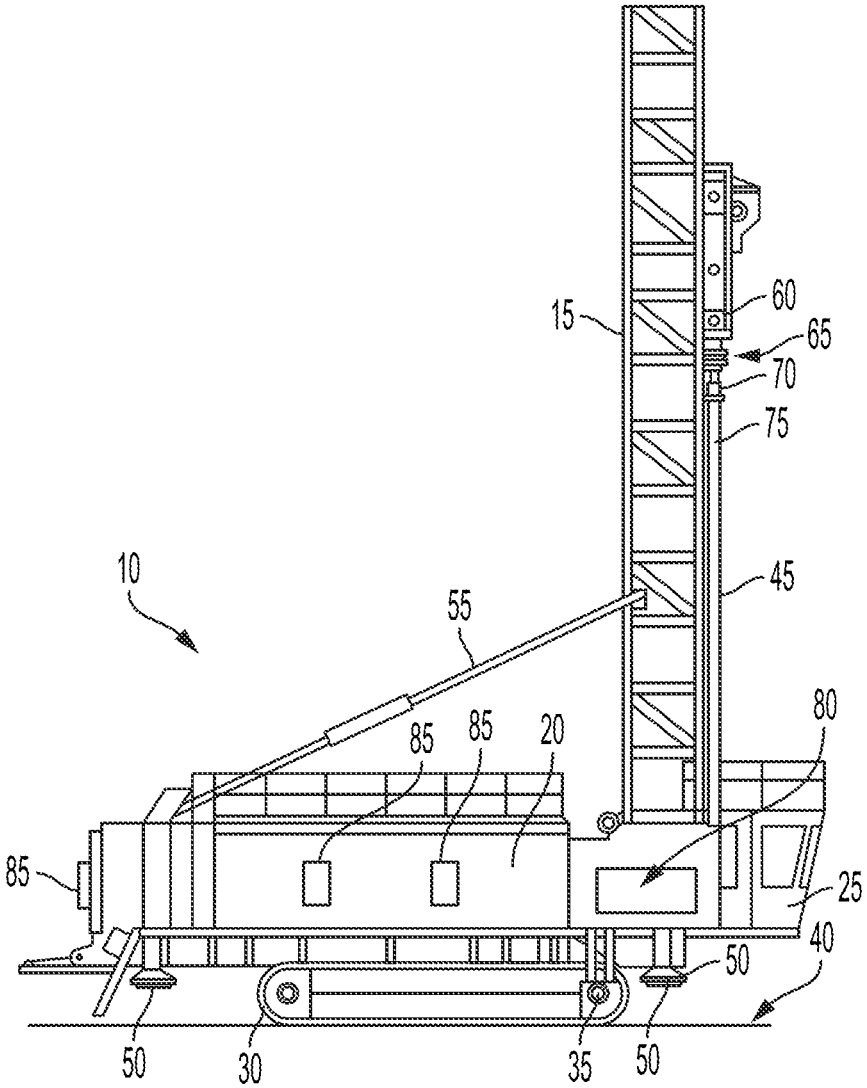
FIG. 1 illustrates a mining machine, according to some embodiments.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more electronic processors, such as a microprocessor and/or application specific integrated circuits ("ASICs"). As such, it should be noted that a plurality of hardware and software based devices, as well as a plurality of different structural components, may be utilized to implement the embodiments. For example, "servers," "computing devices," "controllers," "processors," etc., described in the specification can include one or more electronic processors, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4." The relative terminology may refer to plus or minus a percentage (e.g., 1%, 5%, 10%, or more) of an indicated value.

Functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not explicitly listed.

FIG. 1 illustrates a blasthole drill 10 that includes a drill tower 15, a base 20 (e.g., a machinery house) beneath the drill tower 15 that supports the drill tower 15, an operator cab 25 coupled to the base 20, and crawlers 30 driven by a crawler drive 35 that drives the blasthole drill 10 along a ground surface 40. The blasthole drill 10 also includes a drill pipe 45 configured to extend downward (e.g., vertically) through the ground surface 40 and into a borehole. In some constructions, multiple drill pipes 45 are connected together to form an elongated drill string that extends into the borehole. The blasthole drill 10 also includes leveling jacks 50 coupled to the base 20 that support the blasthole drill 10 on the ground surface 40, and a brace 55 coupled to both the base 20 and the drill tower 15 that supports the drill tower 15 on the base 20. The drill tower 15 includes a drill head motor 60 coupled to the drill tower 15 that drives a drill head 65 and a coupling 70 that couples together the drill head 65 with an upper end 75 of the drill pipe 45. The blasthole drill 10 also includes a bit changer assembly 80 that manually or autonomously exchanges a drill bit on a lower end of the drill pipe 45. The bit changer assembly 80 also stores inactive drill bits during operation of the blasthole drill 10. Other constructions of the blasthole drill 10 do not include, for example, the operator cab 25, the brace 55, or one or more other components as described above. The blasthole drill 10 also includes a plurality of sensor-lights 85 positioned around the drill 10 at various locations. Each of the sensor-lights 85 includes at least one proximity sensor configured to detect an object (e.g., a person, truck, or the like) in the vicinity of the blasthole drill 10 and a light configured to provide visual feedback towards the object, as described in further detail below. The vicinity of the mining machine refers to, for example, the area around the drill 10 within a predetermined distance from the outer surfaces of the mining machine, the area around the drill 10 within a predetermined distance from a center point or other selected point of the mining machine, or the area around the drill 10 within sensing range of the proximity sensor of the sensor-lights 85.

Figure 2:
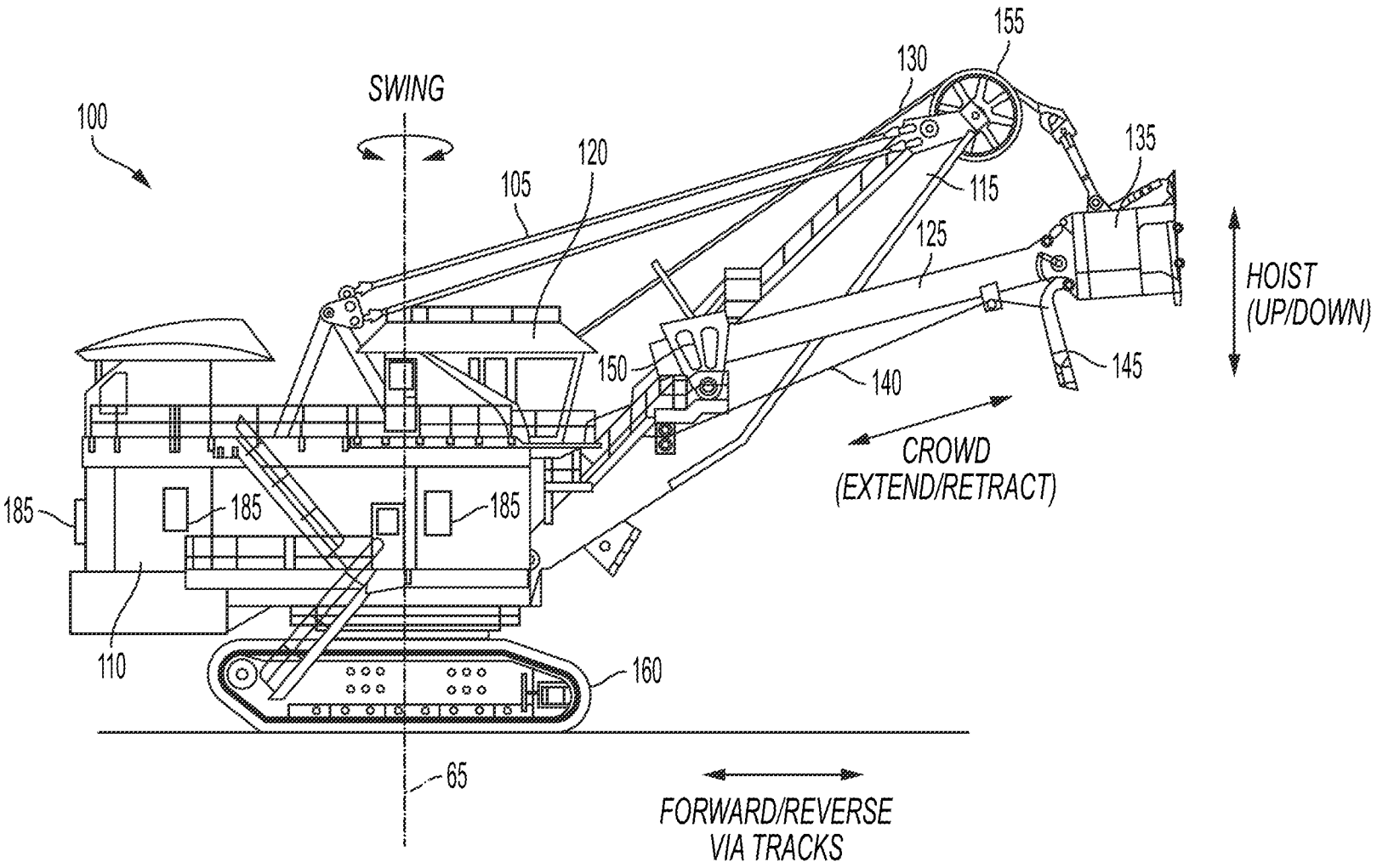
FIG. 2 illustrates a mining machine, according to some embodiments.

FIG. 2 illustrates a rope shovel 100 that includes suspension cables 105 coupled between a base 110 and a boom 115 for supporting the boom 115, an operator cab 120, and a dipper handle 125. The rope shovel 100 also includes a wire rope or hoist cable 130 that may be wound and unwound within the base 110 to raise and lower an attachment or dipper 135, and a trip cable 140 connected between another winch (not shown) and the door 145. The rope shovel 100 also includes a saddle block 150 and a sheave 155. The rope shovel 100 uses four main types of movement: forward and reverse, hoist, crowd, and swing. Forward and reverse moves the entire rope shovel 100 forward and backward using the tracks 160. Hoist moves the attachment 135 up and down. Crowd extends and retracts the attachment 135. Swing pivots the rope shovel 100 around an axis 165. Overall movement of the rope shovel 100 utilizes one or a combination of forward and reverse, hoist, crowd, and swing. Other constructions of the rope shovel 100 do not include, for example, the operator cab 120 or one or more other components as described above. The rope shovel 100 also includes a plurality of sensor-lights 185 positioned around the shovel 100 at various locations. Each of the sensor-lights 85 includes at least one proximity sensor configured to detect an object (e.g., a person, truck, or the like) in the vicinity of the rope shovel 100 and a light configured to provide visual feedback towards the object, as described in further detail below. The vicinity of the mining machine refers to, for example, the area around the rope shovel 100 within a predetermined distance from the outer surfaces of the mining machine, the area around the rope shovel 100 within a predetermined distance from a center point or other selected point of the mining machine, or the area around rope shovel 100 within sensing range of the proximity sensor of the sensor-lights 85.

Figure 3A:
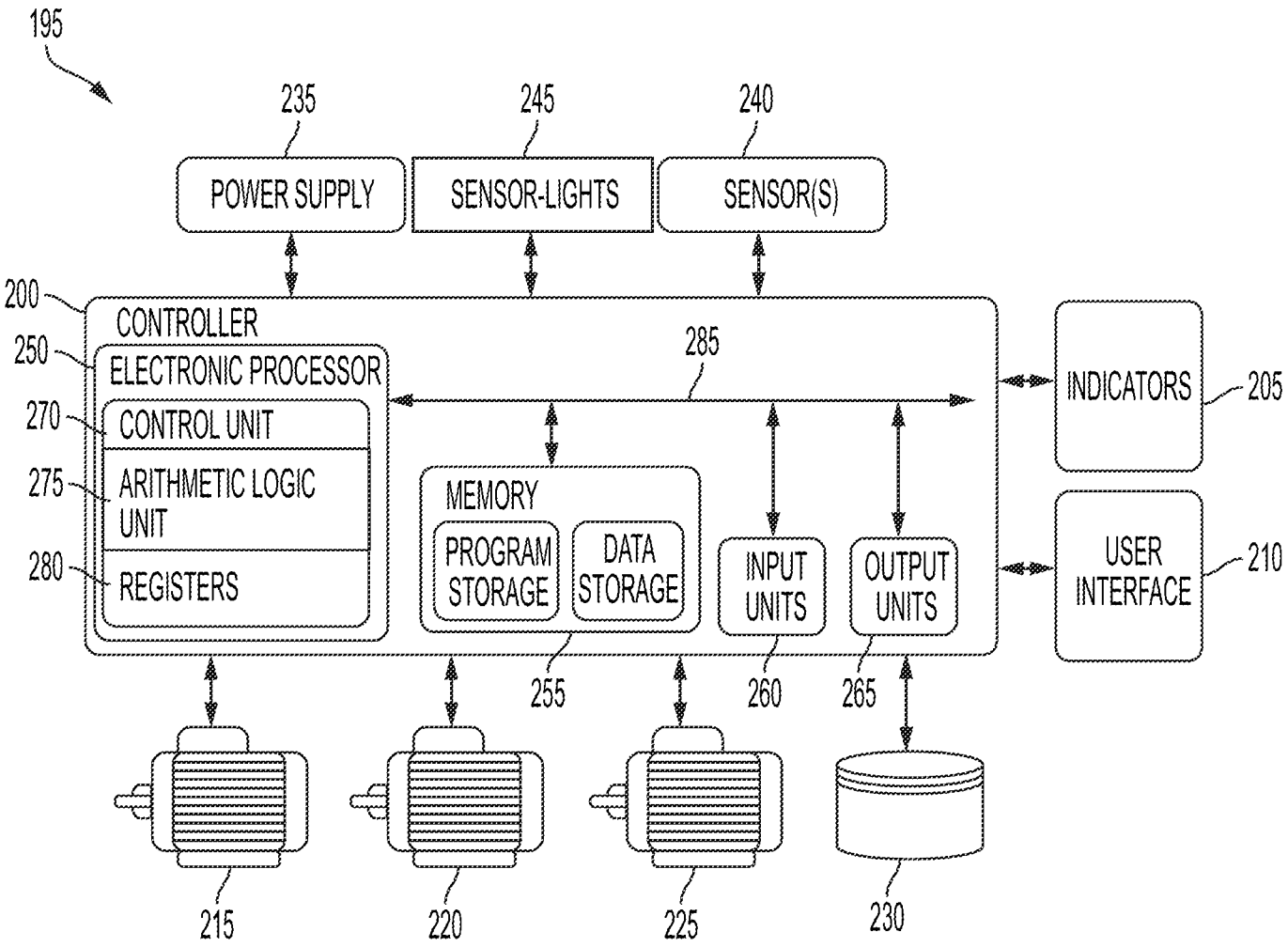
FIG. 3A illustrates a control system for a mining machine, according to some embodiments.

FIG. 3A illustrates a block diagram of a mining machine 195. The mining machine 195 is, for example, the blasthole drill 10 of FIG. 1, the rope shovel 100 of FIG. 2, or another mining machine. Although embodiments herein are described with respect to the mining machine 195 (a type of an industrial machine), in some embodiments, the systems and methods described herein are for use with other (non-mining) types of mobile industrial machines, such as construction equipment (e.g., a crane), a ship, or the like.

The mining machine 195 includes a controller 200. The controller 200 is electrically and/or communicatively connected to a variety of modules or components of the mining machine 195. For example, the illustrated controller 200 is connected to one or more indicators 205, a user interface module 210, one or more first actuation devices (e.g., motors, hydraulic cylinders, etc.) and first drives 215, one or more second actuation devices (e.g., motors, hydraulic cylinders, etc.) and second drives 220, one or more third actuation devices (e.g., motors, hydraulic cylinders, etc.) and third drives 225, a data store or database 230, a power supply module 235, one or more sensors 240, and a plurality of sensor-lights 245 (e.g., the sensor-lights 85 or 185). The first actuation devices and drives 215, the second actuation devices and drives 220, and the third actuation devices and drives 225 are configured to receive control signals from the controller 200 to control, for example, hoisting, crowding, and swinging operations of the mining machine 100. The controller 200 includes combinations of hardware and software that are configured, operable, and/or programmed to, among other things, control the operation of the mining machine 195, generate sets of control signals to activate the one or more indicators 205 (e.g., a liquid crystal display ["LCD"], one or more light sources [e.g., LEDs], etc.), monitor the operation of the mining machine 195, etc. The one or more sensors 240 include, among other things, a loadpin, a strain gauge, one or more inclinometers, gantry pins, one or more motor field modules (e.g., measuring motor parameters such as current, voltage, power, etc.), one or more rope tension sensors, one or more resolvers, RADAR, LIDAR, one or more cameras, one or more infrared sensors, etc.

The controller 200 includes a plurality of electrical and electronic components that provide power, operational control, and protection to the components and modules within the controller 200 and/or mining machine 195. For example, the controller 200 includes, among other things, an electronic processor 250 (e.g., a microprocessor, a microcontroller, or another suitable programmable device), a memory 255, input units 260, and output units 265. The electronic processor 250 includes, among other things, a control unit 270, an arithmetic logic unit ("ALU") 275, and a plurality of registers 280 (shown as a group of registers in FIG. 3A), and is implemented using a known computer architecture (e.g., a modified Harvard architecture, a von Neumann architecture, etc.). The electronic processor 250, the memory 255, the input units 260, and the output units 265, as well as the various modules connected to the controller 200 are connected by one or more control and/or data buses (e.g., common bus 285). The control and/or data buses are shown generally in FIG. 3A for illustrative purposes. The use of one or more control and/or data buses for the interconnection between and communication among the various modules and components would be known to a person skilled in the art in view of the embodiments described herein.

The memory 255 is a non-transitory computer readable medium that includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The electronic processor 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the mining machine 195 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The power supply module 235 supplies a nominal AC or DC voltage to the controller 200 or other components or modules of the mining machine 195. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or mining machine 195. In other constructions, the controller 200 or other components and modules within the mining machine 195 are powered by one or more batteries or battery packs, or another grid-independent power source (e.g., a generator, a solar panel, etc.).

The user interface module 210 is used to control or monitor the mining machine 195. The user interface module 210 includes a combination of digital and analog input or output devices required to achieve a desired level of control and monitoring for the mining machine 195. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, or the like. The user interface module 210 can also be configured to display conditions or data associated with the mining machine 195 in real-time or substantially real-time. For example, the user interface module 210 is configured to display measured electrical characteristics of the mining machine 195, the status of the mining machine 195, etc. In some implementations, the user interface module 210 is controlled in conjunction with the one or more indicators 205 (e.g., LEDs, speakers, etc.) to provide visual or auditory indications (e.g., from a horn of the mining machine 195) of the status or conditions of the mining machine 195. In some implementations, the mining machine 195 is an autonomous mining machine that does not require the user interface module 210. In such implementations, the user interface module 210 can be included in the mining machine 195 as a backup or to enable monitoring of the mining machine 195.

Figure 3B:
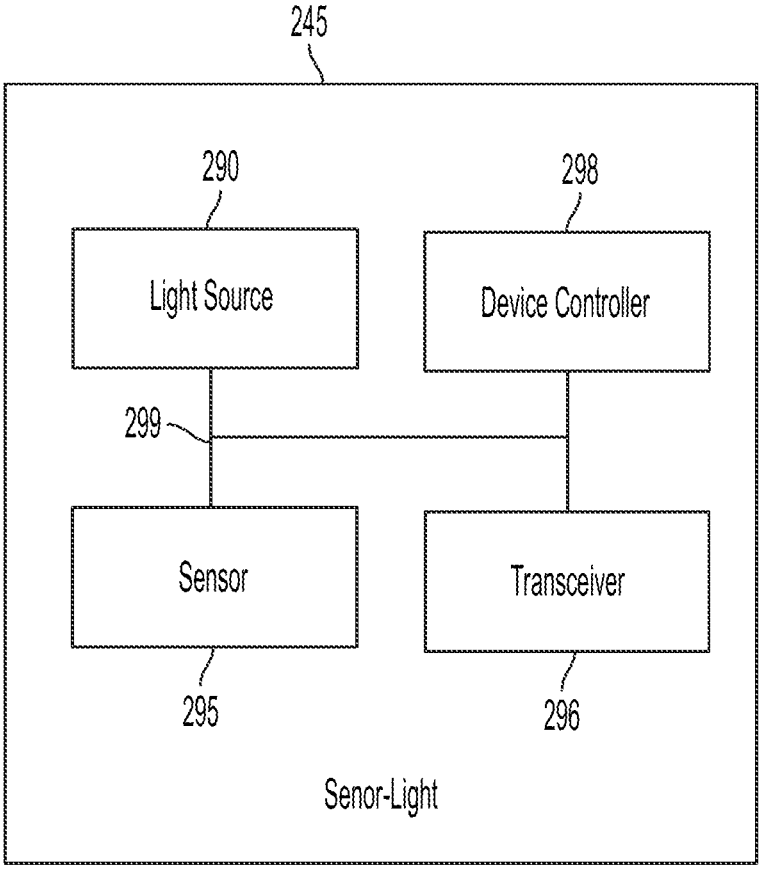
FIG. 3B illustrates a sensor-light of the mining machine, according to some embodiments.

FIG. 3B illustrates an example of the sensor-light 245, which includes a light source 290 and a 295. With reference to both FIGS. 3A and 3B, the controller 200 is configured to implement a proximity detection system ("PDS") or an obstacle detection systems ("ODS") that uses, for example, the sensors 295 of the sensor-lights 245 to detect and classify objects in proximity to the mining machine 195 and the light sources 290 of the sensor-lights 245 to provide visual feedback regarding the detected and classified objects. PDS and ODS are used interchangeably herein. For example, the PDS can use a combination of RADAR, LIDAR, and infrared sensors as the sensors 295 of the sensor-lights 245 to detect objects in proximity to the mining machine 195 and classify the object as either a large object (e.g., a haul truck) or a small object (e.g., a person). An example of a PDS that can be used to detect an object in proximity to the mining machine 195 is described in U.S. Pat. No. 8,768,583, issued Jul. 1, 2014 and entitled "COLLISION DETECTION AND MITIGATION SYSTEMS AND METHODS FOR A SHOVEL," the entire content of which is hereby incorporated by reference.

In some embodiments, the sensor-light 245 further includes a transceiver 296 and a device controller 298 (having a similar construction as the controller 200), where the light source 290, the sensor 295, and the transceiver 296 are coupled to the device controller 298 via a bus 299. Each sensor-light 245 may have an independent housing (e.g., represented by the box outlining the sensor-light 245 in FIG. 3B) that may be mounted to an outer surface of the mining machine 195. The device controller 298 has instructions stored on a device memory thereof, and a device electronic processor configured to execute the instructions to implement the functionality of the device controller 298 described herein. The device controller 298 is configured to communicate with the controller 200 via the transceiver 296. For example, the device controller 298 is configured to receive commands from the controller 200 to activate the light source 290 (e.g., at a particular intensity, color, strobing frequency, or combination thereof), to control the light source 290 according to received commands, and to activate the sensor 295 to scan for objects. Additionally, the device controller 298 is configured to output obstacle data to the controller 200 via the transceiver 296. The obstacle data may include, for example, two-dimensional or three-dimensional coordinates (e.g., with the sensor-light 245 at the origin position of the coordinate system) for objects sensed by the sensor 295.

After the controller 200 has detected and classified an object in proximity to the mining machine 195, the controller 200 is configured to control the sensor-lights 245 to provide a visual indication to, for example, an individual external to the mining machine 195 that the PDS has detected his or her presence. Individuals in the mining machine 195 would be able to see the outputs of the PDS (e.g., with the user interface module 210) including the direction to a detected object, a distance to the object, and a risk severity. However, that information would conventionally not be available to off-board individuals external to the mining machine 195. The light sources 290 of the sensor-lights 245 are mounted to external surfaces of the mining machine 195 and provide the visual indication to individuals external to the mining machine 195. The light sources 290 provide, for example, directional information related to specific areas in which the PDS detects an object, which enables multiple objects (e.g., multiple people) in different areas (e.g., left, right, front, back, etc.) around the mining machine 195 to observe their specific status in relation to the PDS (e.g., based on which lights are illuminated) and the manner in which the lights are illuminated (e.g., strobing speed, color, intensity, etc.). These processes are described in further detail below with respect to, for example, FIGS. 5-14B.

The light sources 290 of the sensor-lights 245 are, for example, high intensity programmable strobes. The strobes can be any type of light source (e.g., LEDs) and can produce any desirable output color (e.g., green, yellow, red, etc.). The controller 200 is configured to control the frequency of the strobing of the light sources 290, the magnitude or intensity of the output of the light sources 290, the color of the output of the light sources 290, etc., for example, by sending commands to the device controller 298. The controller 200 controls the output of the light sources 290 based on, for example, the type of object detected (e.g., person, vehicle, etc.), the proximity of the object to the mining machine 195, etc. In some embodiments, as an object gets closer and closer to the mining machine, light sources 290 are strobed at an increasingly high frequency (e.g., linearly dependent upon proximity), which indicates that the object has been detected and the proximity of the object to the mining machine is being tracked. In some embodiments, when the PDS detects a large object (e.g., a haul truck) the light sources 290 can be illuminated in a first color (e.g., blue) and when the PDS detects a small object (e.g., a person) the light sources 290 are illuminated in a second color (e.g., red). In some embodiments, as an object gets closer and closer to the mining machine, light sources 290 are activated at an increasingly high intensity (e.g., linearly dependent upon proximity), which indicates that the object has been detected and the proximity of the object to the mining machine is being tracked.

Although the sensor-light 245 in FIG. 3B is illustrated as having one light source 290 and one sensor 295, in some embodiments, the sensor-light 245 includes more than one light source 290, more than one sensor 295, or more than one of both the light source 290 and the sensor 295. In some embodiments, a light-only version of the sensor-light 245 is provided, which may be referred to as a light unit, and in which one or more of the lights 290 are included, but the sensor 295 is not included. The light unit performs the light-related functions of the sensor-light 245 described herein but does not provide the sensing functions. In some embodiments, a sensor-only version of the sensor-light 245 is provided, which may be referred to as a sensor unit, and in which one or more of the sensors 295 are provided, but the light source 290 is not provided. The sensor unit performs the sensor-related functions of the sensor-light 245 described herein but does not provide the visual feedback functions.

In some of the description provided herein, the sensor-lights 245 are described as illuminating, flashing, or the like. Unless otherwise noted, such description refers to the light sources 290 of the sensor-lights 245 being illuminated, flashing, or the like. Similarly, in some of the description provided herein, the sensor-lights 245 are described as sensing an object. Unless otherwise noted, such description refers to the sensors 295 of the sensor-lights 245 sensing an object.

Figure 4:
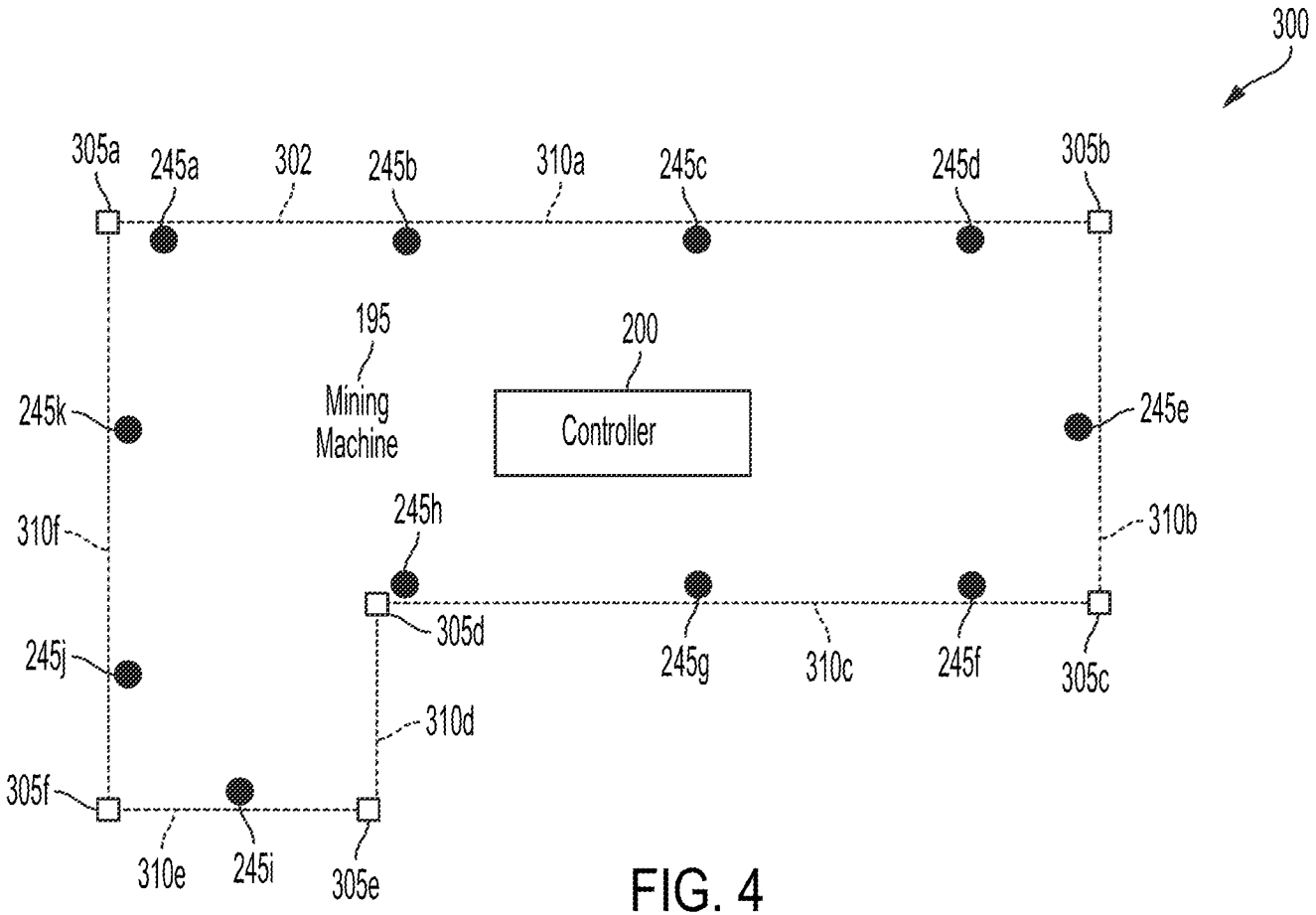
FIG. 4 illustrates a configuration of sensor/light modules around the perimeter of a mining machine, according to some embodiments.

FIG. 4 illustrates one embodiment of an object detection system ("ODS") 300 on the mining machine 195 including the sensor-lights 245 (individually labeled 245*a*-*k*) and the controller 200. Although the system 300 is illustrated in FIG. 4 as having eleven sensor-lights 245, in some embodiments, more or fewer lights are provided on the mining machine 195. Additionally, in some embodiments, the sensor-lights 245 are distributed along the perimeter in a different way such that one or more of the sides of the mining machine 195 has more or fewer sensor-lights 245 than illustrated. Additionally, in some embodiments, additional light units (light-only versions of the sensor-lights 245), sensor units (sensor-only versions of the sensor-lights 245), or both light units and sensor units are also included at one or more locations along the perimeter. In other words, the number of sensor-lights 245 and positioning of the sensor-lights 245 on the mining machine 195 shown in FIG. 4 is for illustrative purposes, and other arrangements of sensor-lights 245 are used in other embodiments.

By including the sensor-lights 245 around the exterior of the mining machine 195, a subset of the sensor-lights 245 can be activated to provide a targeted indication to an object external to the mining machine 195 that the ODS 300 has detected the object's presence. The controller 200 is configured to determine a virtual perimeter 302 of the mining machine 195. The virtual perimeter 302 is a polygonal approximation of the outer shape of the mining machine 195 made up of straight linear segments 310*a-f*. The linear segments 310*a-f* are each defined by a pair of respective end points 305*a-f* of the virtual perimeter 302. For example, the segment 310*a* of the virtual perimeter 302 is defined by end points 305*a* and 305*b*, while the segment 310*b* is defined by the end points 305*b* and 305*c*. In some embodiments, a subset of the sensor-lights 245 is associated with one or more of segments 310*a-f*. For example, the sensor-lights 245*a-d* are associated with the segment 310*a*, creating a first subset of the sensor-lights 245; the sensor-light 245*e* is associated with the segment 310*b*, creating a second subset of the sensor-lights 245; the sensor-lights 245*f-h* are associated with the segment 310*c*, creating a third subset of the sensor-lights 245; the sensor-light 245*i* is associated with the segment 310*e*, creating a fourth subset of the sensor-lights 245; and the sensor-lights 245*j-k* are associated with the segment 310*f*, creating a fifth subset of the sensor-lights 245. In some embodiments, a sensor light 245 is also provided on the segment 310*d*, creating another subset of the sensor-lights 245. The virtual perimeter 302 may be stored in the memory 255 as part of a two-dimensional coordinate map for the mining machine 195, where the origin of the coordinate map may be selected, for example, as a central point within the mining machine 195. For example, the coordinate map may be implemented as a Cartesian map where each end point 305*a-f* is defined by a two-dimensional coordinate pair. Additionally, each of the sensor-lights 245 may also be defined as a two-dimensional coordinate pair on the coordinate map. The coordinates of each sensor-lights 245 may define the position of the sensor-light 245 as being on one of the segments 310*a-f*. The coordinate map and, thus, the coordinates of the virtual perimeter 302, end points 305*a-f*, segments 310*a-f*, and sensor-lights 245 may be stored (or updated) in the memory 255 as part of a configuration or setup process for the ODS 300, and may be retrieved by the electronic processor 250 for use in the methods described herein.

Figure 5:
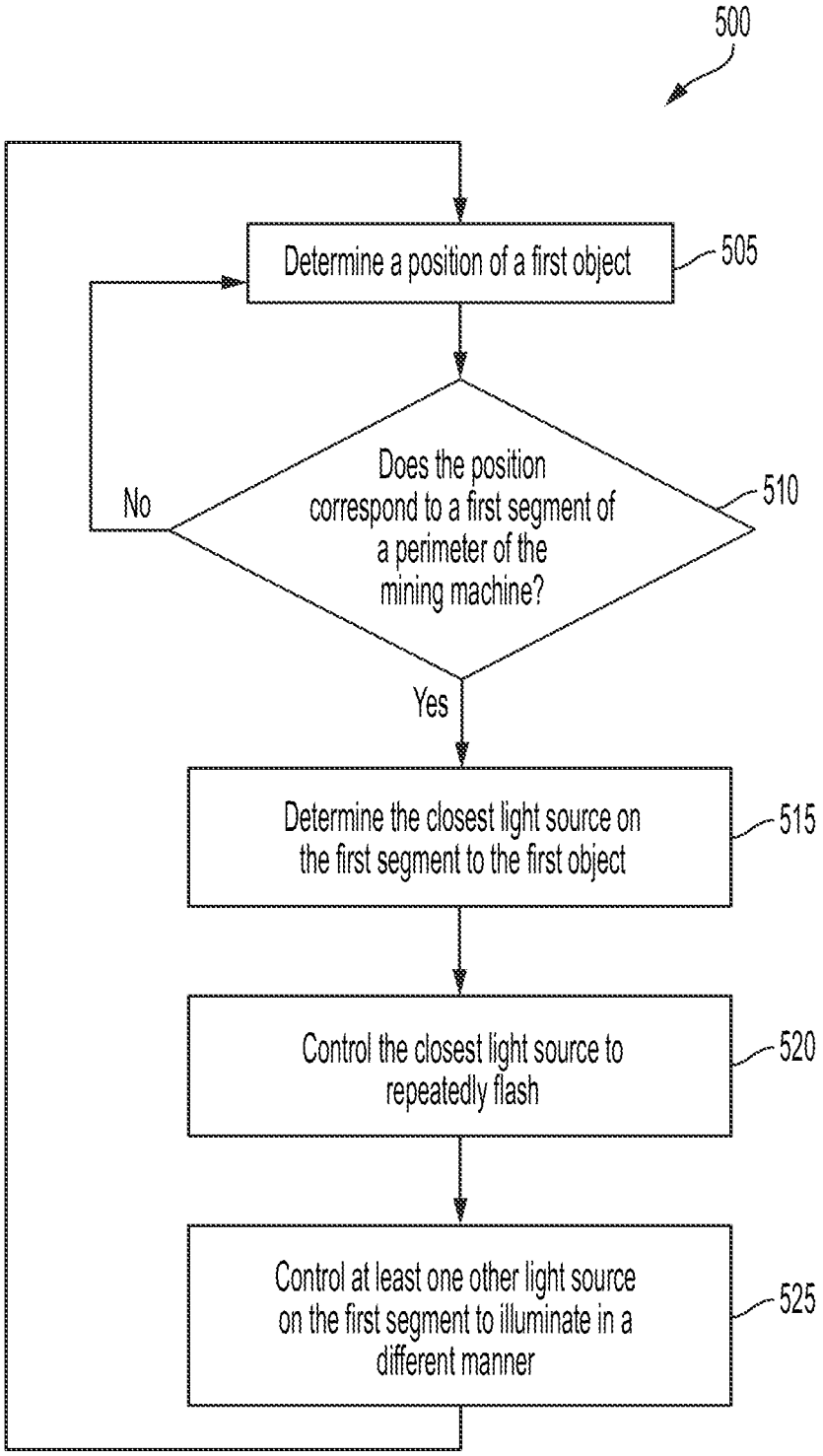
FIG. 5 is a method for detecting a first object within the vicinity of a mining machine, according to some embodiments.

FIG. 5 is a method 500 of the ODS system 300 for detecting an object (e.g., a person, vehicle, tool, etc.) within a vicinity of the mining machine 195 and for providing visual feedback directed towards the object (i.e., external to the mining machine 195). Although the method 500 is described with respect to the ODS system 300 and the mining machine 195, the method 500 may also be implemented by other systems and mining machines.

Figure 6A:
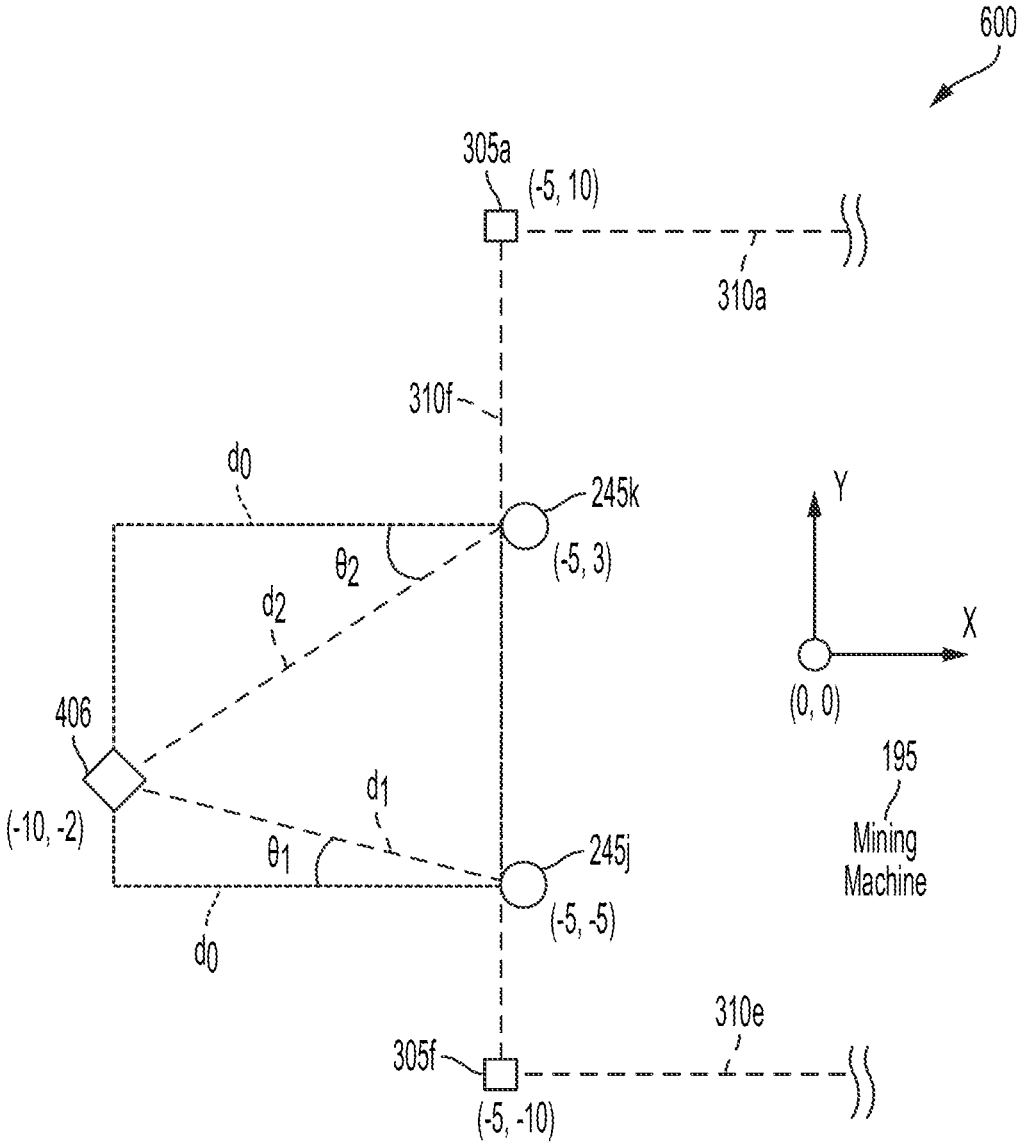
FIGS. 6A and 6B illustrate a first object detected within the vicinity of a mining machine, according to some embodiments.

In STEP 505, the electronic processor 250 determines a position of the object based on a first output from a proximity sensor of the mining machine. The proximity sensor is, for example, the sensor 295 of a first sensor-light of the sensor-lights 245. The method 500 will be described with respect to an example provided in FIGS. 6A-6B, which include a diagram 600 and 605, respectively, illustrating a portion of the mining machine 195 and an object 406. Accordingly, as an example for purposes of explanation of the method 500, the first sensor-light of the sensor-lights 245 will be described as the sensor-light 245*j*, and the object will be described as the object 406. With reference to FIG. 6A, the sensor-light 245*j* senses an object 406 in the vicinity of the mining machine 195. The sensor-light 245*j* may output obstacle data for the sensed object 406 in terms of a first distance ($d_1$) between the sensor-light 245*j* and the object 406 and a first angle ($\Theta_1$) with respect to a line normal to the segment 310*f*. Similarly, the sensor-light 245*k* may also sense the object 406 and output obstacle data for the sensed object 406 in terms of a second distance ($d_2$) and second angle ($\Theta_2$). Because, as previously noted, the electronic processor 250 has access to the two-dimensional coordinate map for the mining machine 195 that includes the positions of the end points 305, the segments 310, and the sensor-lights 245, the electronic processor 250 is configured to use conventional trigonometric principles to translate the obstacle data from either or both of the sensor-lights 245*j*, 245*k* to a two-dimensional coordinate position for the object 412 on the two-dimensional coordinate map. In an example coordinate map of the mining machine 195 in FIG. 6A, an origin point (0,0) is illustrated, the end point 305*a* has coordinates (−5, 10), the end point 305*f* has coordinates (−5, −10), the sensor-light 245*j* has coordinates (−5, −5), the sensor-light 245*k* has coordinates (−5, 3), and the electronic processor 406 determines that the object 406 has a position of (−10, −2) on the coordinate map. The size, type, and precision of the coordinate system is merely an example for illustration purposes, and various coordinate system types, units, and precision levels are used in other embodiments.

Returning to FIG. 5, in step 510, the electronic processor 250 determines whether the position of the object 406 corresponds to a first segment of the perimeter 302 of the mining machine, where the first segment is associated with a first plurality of light sources (e.g., the sensor-lights 245 on the given segment). In some embodiments, the electronic processor 250 determines that the position of the object 406 corresponds to a first segment when the electronic processor 250 determines that the position of the object is between two consecutive end points 305*a-f* of the virtual perimeter 302 and is adjacent the segment 310*a-f* joining those consecutive end points 305*a-f*. For example, with reference to FIG. 6A, the object 406 has a y position value of (−2) on the coordinate map, which is between the y position of the consecutive end points 305*a* (y position of 10) and 305*f* (y position of −10). Stated another way, the object 406 is between the end points 305*a* and 305*f* because the object 406 is located between respective perpendicular lines (not shown) extending away from the mining machine 195 from the end points 305*a* and 305*f* (i.e., extending to the left, in FIG. 6A).

Additionally, the object 406 has an x position value of (−10), which is adjacent the line segment 310*f*. The object 406 may be considered adjacent to a line segment 310*a-f* when the object 406 merely by being within range of the sensing capabilities of one of the sensor-lights 245, or may be considered adjacent to a line segment 310*a-f* when the object 406 is within a threshold distance from the line segment. For example, when the threshold distance is 10 units on the coordinate map, the object 406 is within that threshold distance because the distance do between −10 (the x position of the object 406) and −5 (the x position of the segment 310*f*) is 5 units.

Returning to FIG. 5, when in step 510, the electronic processor 250 determines that the position of the object does not correspond to a first segment of the perimeter 302, the electronic processor 250 returns to STEP 505 to determine a new position of the first object (e.g., as the object moves) or another object. However, when the electronic processor 250 determines that the position of the object corresponds to a first segment of the perimeter, the electronic processor 250 proceeds to STEP 515.

In STEP 515, the electronic processor 250 determines a first light source of the first plurality of light sources (e.g., one of the sensor-lights 245), associated with the first segment of the perimeter 302, that is closest to the object 406 using the position of the object 406. For example, with reference to FIG. 6B, the electronic processor 250 determines the distance along the perimeter 302 between the object 406 and each of the sensor-lights 245 of the segment 310*f*, and the sensor-light 245 associated with the shortest distance is determined by the electronic processor 250 to be the closest sensor-light 245. For example, as illustrated, the distance $d_k$ is the distance along the perimeter between the object 406 and the sensor-light 245*k*, and the distance $d_j$ is the distance along the perimeter between the object 406 and the sensor-light 245*j*. Here, the distance $d_k$ is the difference between the y position of the senor-light 245*k* and the y position of the object 406 (i.e., $d_k$=3−−2=5), and the distance $d_j$ is the difference between the y position of the sensor-light 245*j* and the y position of the object 406 (i.e., =−2−−5=3). Because $d_j$ is less than $d_k$, the electronic processor 250 determines that the sensor-light 245*j* is the closest of the sensor-lights 245 of the segment 310*f*. In another embodiment, the electronic processor compares the sensed distance from the sensor-lights 245*k* and 245*j* (i.e., $d_1$ and $d_2$ of FIG. 6A), and the sensor-light 245 having the smallest distance is determined by the electronic processor 250 to be the closest of the sensor-lights 245.

Returning to FIG. 5, in STEP 520, the electronic processor 250 controls the first light source of the first plurality of light sources to repeatedly flash in response to determining that the first light source of the first plurality of light sources is closest to the object. For example, with reference to FIG. 6B, the electronic processor 250 sends a command to the sensor-light 245*j* to repeatedly flash (also referred to as strobe). In some embodiments, the command may include on or more of an intensity parameter, a color parameter, and a frequency parameter. The intensity parameter indicates an intensity of the illumination for the light source 290 of the sensor-light 245*j*. For example, the intensity parameter may be a value between 0% intensity (no illumination) and 100% intensity (maximum illumination). The color parameter indicates a color of the light source 290 of the sensor-light 245*j* and may be any color (e.g., white, red, blue, green, yellow, etc.). The frequency parameter indicates the flash rate of the light source 290 of the sensor-light 245*j* (i.e., indicates the number of times the light source 290 will cycle on and off over a given amount of time) and may be, for example, a particular rate (e.g., 0.5, 1 hz, 2 hz) or a value between 0% (e.g., light is steady-on) to 100% (e.g., flashing at maximum frequency). A non-zero flash rate indicates that the light source 290 is flashing.

In some embodiments, the intensity parameter is set in accordance with the distance between the object 406 and the mining machine 195, such as the distance (do) (see FIG. 6B) or the distance ($d_1$) (see FIG. 6A). For example, with reference to FIG. 8, a graph 700 is provided that illustrates an example relationship 715 between the distance ($d_1$) and both the frequency parameter and the intensity parameter of the closest of the sensor-lights 245 (sensor-light 245*j*). A horizontal axis 705 of the graph 700 illustrates the distance ($d_1$), and the vertical axis 710 of the graph 700 illustrates the frequency parameter and the intensity parameter. The relationship 715 is an inverse linear relationship, such that the flash rate and intensity is greatest when the distance is shortest. In some embodiments, the distance do is used in place of $d_1$, but otherwise a similar relationship as illustrated in FIG. 7 is followed. In some embodiments, the electronic processor 250 controls the closest sensor-light 245 according to a different relationship (e.g., one having a different slope, one having constant intensity but varying flash rate, or one being nonlinear).

Returning to FIG. 5, in STEP 525, the electronic processor 250 controls at least one other light source of the first plurality of light sources to illuminate in a different manner than the first light source of the first plurality of light sources. The control of the at least one other light source is in response to determining that the position of the object corresponds to the first segment (but is not the closest light source). For example, with reference to FIG. 6B, the sensor-light 245*k* is at least one other light source on the segment 310*f* that was not determined to be the closest sensor-light 245. Accordingly, in STEP 525, the light source 290 of the sensor-light 245*k* is controlled to illuminate in a different manner than the sensor-light 245*j*. In some embodiments, rather than flashing like the closest light source (e.g., the sensor-light 245*j*), the light source 290 of the sensor light 245*k* is controlled to be illuminated and held steady-on (i.e., not flashing). With the contrasting illumination of the sensor-lights 245 on the segment 310*f*, a person (e.g., as the object 406 or driving the object 406) is able to quickly discern that the object 406 is near the side of the mining machine 195 associated with the segment 310*f*, and that the object 406 is closest to the sensor-light 245*k* (which is flashing).

Figure 6B:
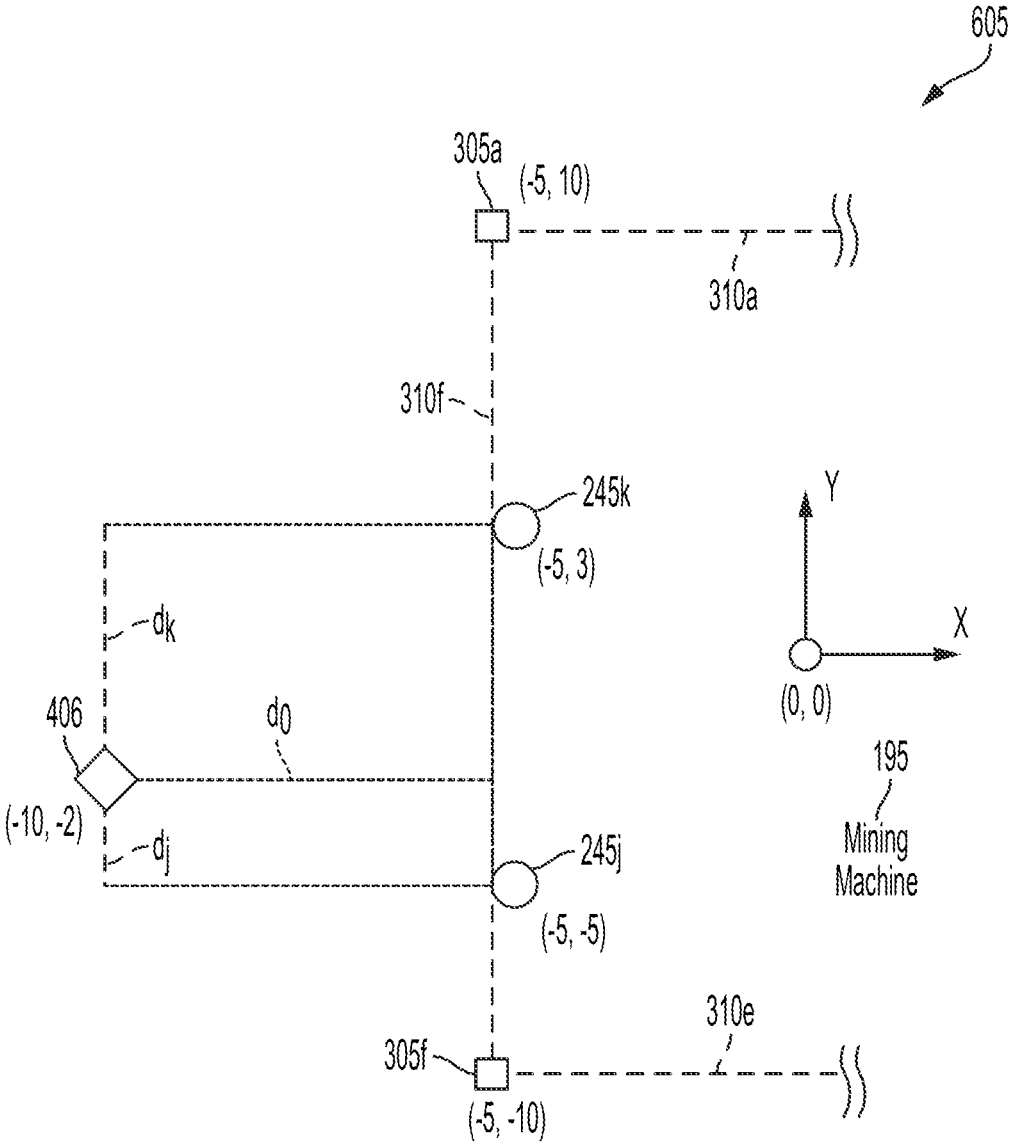
Figure 7:
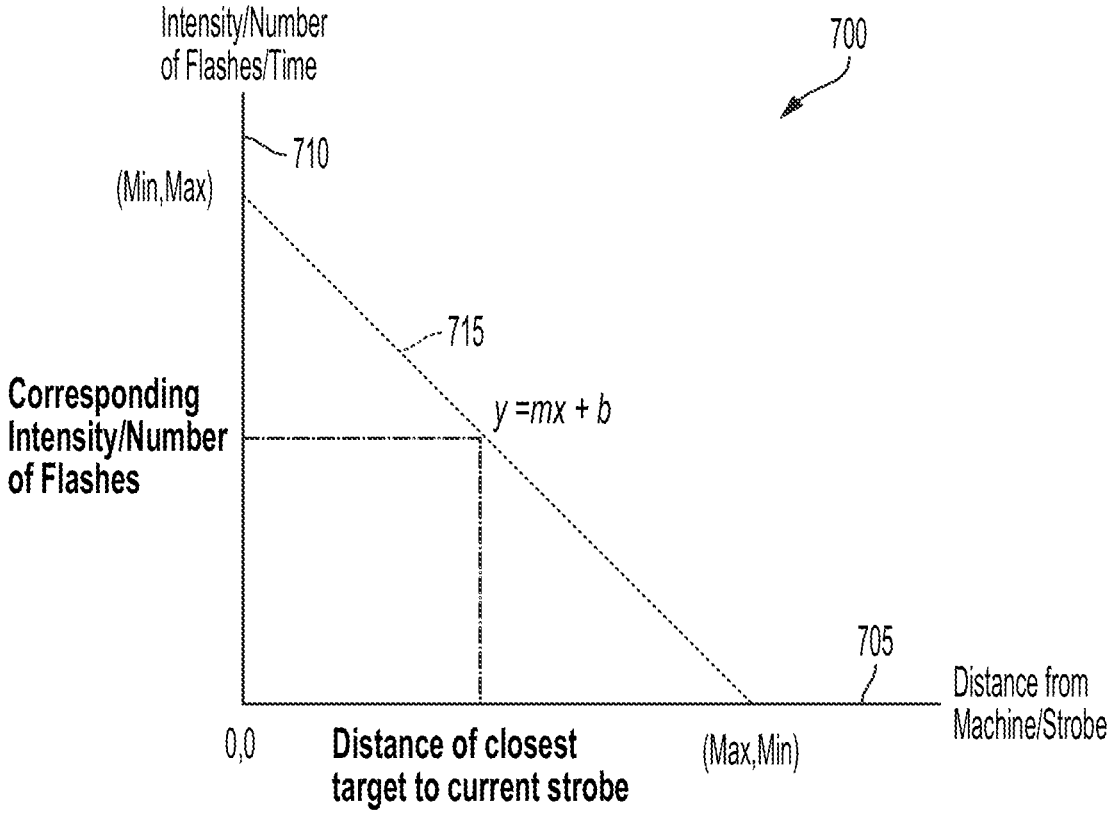
FIG. 7 is a graph of the rate at which a sensor/light module will flash once an object is detected within the vicinity of a mining machine, according to some embodiments.

While the illustrated example of FIG. 6B includes two sensor-lights 245 on the segment 310*f*, in some embodiments, the segment 310*f* includes additional sensor-lights 245, similar to segment 310*a* (see FIG. 4). In such embodiments, the electronic processor 250 may control all of the other sensor-lights 245 on the segment 310*f* (i.e., the first segment determined in STEP 510) similar to the sensor-light 245*k*, such that all sensor-lights 245 on the first segment are illuminated steady-on, except the closest of the sensor-lights 245 (the sensor light 245*j*) that is controlled to repeatedly flash. In some embodiments, rather than controlling these other sensor-lights 245 (e.g., the sensor-light 245*k*) on the segment 310*f* to illuminate steady-on to achieve control in a different manner than the closest sensor light 245 (i.e., the sensor-light 245*j*), the other sensor-lights 245 may be controlled to have a different color, a different flash rate, or a different intensity than the closest sensor light 245. Regardless of the particular differing control technique employed for the closest sensor-light 245 and the other sensor-slights 245 on the same segment 310*a-f*, again, the contrasting illumination of the sensor-lights 245 enables a person (e.g., as the object 406 or driving the object 406) to quickly discern that the object 406 is near the side of the mining machine 195 associated with the particular segment 310*a-f* having illuminated sensor-lights 245, and that the object 406 is closest to the sensor-light 245 that is flashing.

After STEP 525, the electronic processor 250 cycles back to STEP 505 to determine an updated position of the first object using the previously described techniques for determining an object position, and the process proceeds as previously described, except based on the updated position. When the first object is determined to no longer correspond to the first segment, (and presuming no other objects are determined to correspond to the first segment), the sensor-lights 245 are controlled to cease illumination and flashing.

Although the method 500 is described with respect to detecting one object (the object 406), in some embodiments, the ODS system 300 is configured to detect and provide feedback for multiple objects. For example, in some embodiments, the ODS system 300 is configured to detect one or more additional objects that correspond to the same first segment as determined in STEP 510 and is configured to detect one or more additional objects that correspond to one or more other segments 310 of the mining machine 195.

Figure 8A:
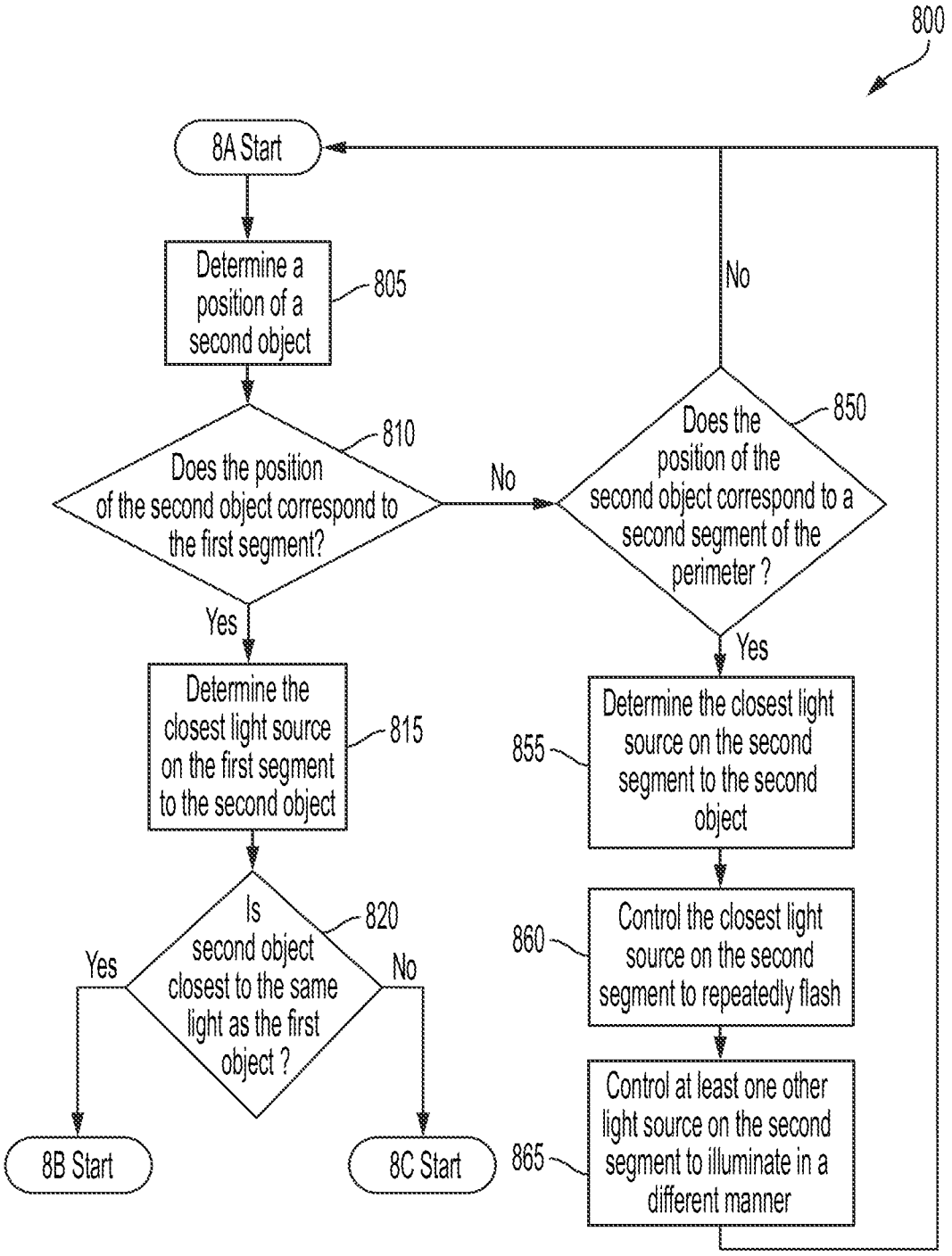
FIGS. 8A, 8B, and 8C are flow charts for detecting a second object within the vicinity of a mining machine, according to some embodiments.
Figure 8B:
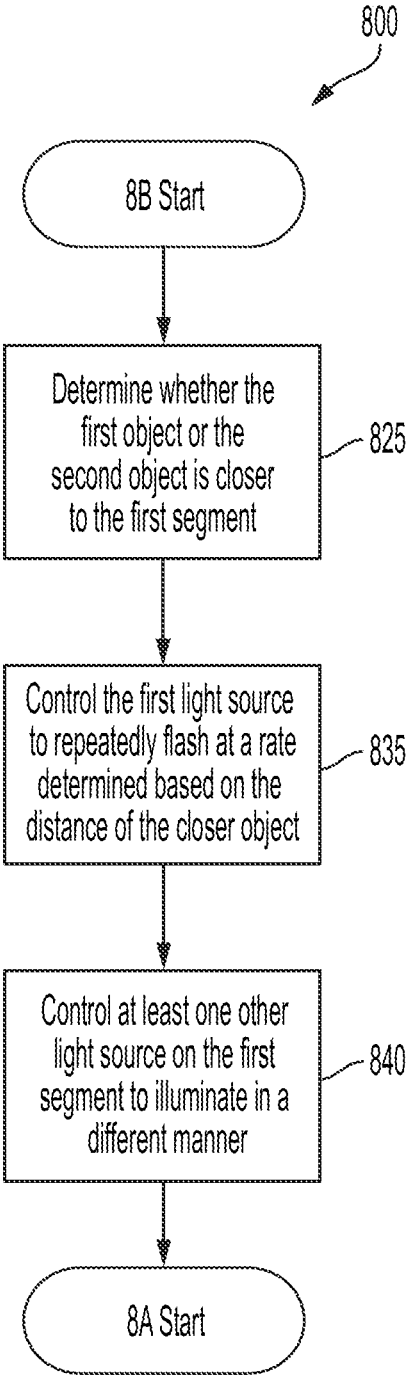
Figure 8C:
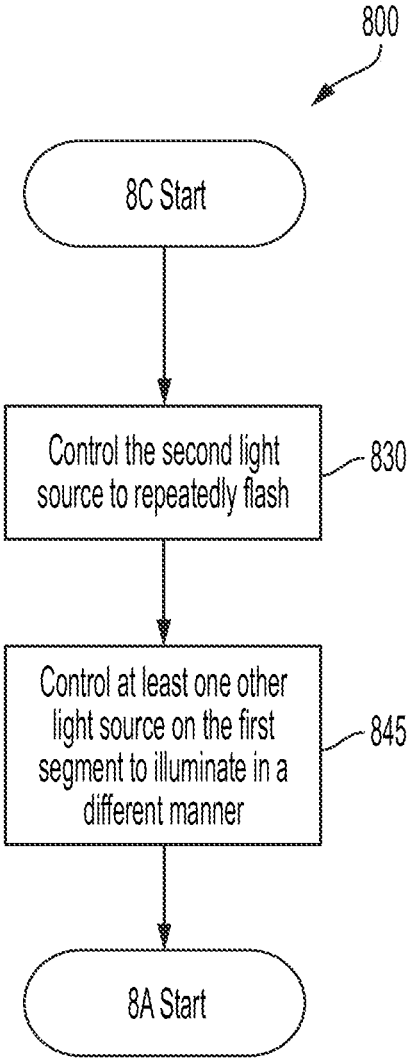

FIGS. 8A, 8B, and 8C illustrate a method 800 of the ODS system 300 for detecting a second object (e.g., a person, vehicle, tool, etc.) within a vicinity of the mining machine 195 and providing visual feedback. The method 800 may be executed by the ODS system 300 following or simultaneously (at least in part) with execution of the method 500 in which the first object is detected. Although the method 800 is described with respect to the ODS system 300 and the mining machine 195, the method 800 may also be implemented by other systems and mining machines. Additionally, the method 800 will be described with respect to the diagram 900 of FIG. 9A, which shows the mining machine 195, the (first) object 406, and (second) objects 905*a*, 905*b*, and 905*c*.

In STEP 805, the electronic processor 250 determines a position of a second object based on a first output from a proximity sensor of the mining machine. The proximity sensor is, for example, the sensor 295 of one of the sensor-lights 245. The second object may be, for example, one of the objects 905*a*, 905*b*, and 905*c*. Reference to the second object 905 herein generically refers to one of the objects 905*a*, 905*b*, or 905*c*. To determine the position of the second object 905, the electronic processor 250 receives, for example, obstacle data from the sensor 295 of one of the sensor-lights 245 indicating a distance and angle of the detected second object 905 from the sensor 295, such as described with respect to STEP 505 of FIG. 5. In some embodiments, the electronic processor 250 is configured to use conventional trigonometric principles to translate the obstacle data to a two-dimensional coordinate position for the object 905 on the two-dimensional coordinate map of the controller 200, as also described with respect to STEP 505 of FIG. 5.

Returning to FIG. 8A, in STEP 810, the electronic processor 250 determines whether the position of the second object 905 corresponds to the first segment of the perimeter of the mining machine previously determined to correspond to the first object referred to in STEP 505-510 of FIG. 5. For example, with reference to FIG. 9A, the electronic processor 250 determines whether the position of the second object 905 corresponds to the segment 310*f*, which was determined to correspond to the first object 406. Similar techniques as described above with respect to STEP 510 to determine whether an object corresponds to a segment of the perimeter 302 may be used to implement STEP 810. For example, the electronic processor 250 may determine that the second object 905 corresponds with the first segment 310*f* when the position of the second object 905 is between the two consecutive end points 305*a* and 305*f* defining the first segment 310*f*, and where the position of the second object 905 is adjacent to the segment 310*f*. For example, with reference to FIG. 9A, the second objects 905*a* and 905*b* correspond to the first segment 310*f*, but the second object 905*c* does not corresponds to the first segment 310*f* (as discussed below, the second object 905*c* corresponds to the segment 310*c*).

Returning to FIG. 8A, in STEP 815, after the electronic processor 250 determines that the second object 905 corresponds to the first segment 310*f*, the electronic processor 250 determines the closest sensor-light (of the plurality of sensor-lights 245 associated with the first segment 310*f*) to the second object 905. Similar techniques to detect the closest sensor-light 245 described above with respect to STEP 515 may also be used to implement STEP 815.

When the electronic processor 250 determines that the second object 905 is closest to the (same) first sensor-light 245 as the first object 406, the electronic processor proceeds to STEP 825 of FIG. 8B. For example, the closest sensor-light 245 for both the first object 406 and the second object 905*a* is the sensor-light 245*j*. Accordingly, when the second object 905*a* is detected in STEP 805, ultimately, the electronic processor 250 would proceed to STEP 825. When the electronic processor 250 determines that the second object 905 is closest to one of the sensor-lights 245 other than the first sensor-light 245 closest to the first object 406, the electronic processor 250 proceeds to STEP 830 of FIG. 8C. For example, the closest sensor-light 245 for the first object 406 is the sensor-light 245*j*, while the second object 905*b* is closet to the sensor-light 245*k*. Accordingly, when the second object 905*b* is detected in STEP 805, ultimately, the electronic processor 250 would proceed to STEP 830.

Turning to FIG. 8B, in step 825, the electronic processor 250 determines whether the first object or the second object is closer to the first segment. For example, the electronic processor 250 may compare the distance value provided by the sensor-light 245 closest to the first and second object, and the object with the distance value that indicates the shortest distance may be selected as the closer of the two objects. In STEP 835, the electronic processor 250 controls the first light source of the first plurality of light sources to repeatedly flash at a rate determined based on the distance of the closer of the two objects. For example, with reference to FIG. 9A, the electronic processor 250 determines that the second object 905*a* is closer to the sensor-light 245*j* than the first object 406 and, accordingly, sends a command to the sensor-light 245*j* to repeatedly flash at a rate proportional to the distance between the second object 905*a* and the mining machine 195, rather than at a rate proportional to the distance between the first object 406 and the mining machine 195. See, for example, the graph 700 of FIG. 7 and related discussion regarding control of the flash rate based on distance from an object to the mining machine 195.

Additionally, in STEP 840, the electronic processor 250 controls at least one other light source on the first segment to illuminate in a different manner than the closest light source, as previously described with respect STEP 525 of FIG. 5. For example, with reference to FIG. 9A, the electronic processor 250 controls the sensor-light 245*k* to illuminate in a different manner than the sensor-light 245*j*. In some embodiments, in STEP 840, the electronic processor 250 controls all of the other light sources on the first segment to illuminate in a different manner than the closest light source. The electronic processor 250 then returns to STEP 805 of FIG. 8A to determine an updated position for the second object.

Figure 9A:
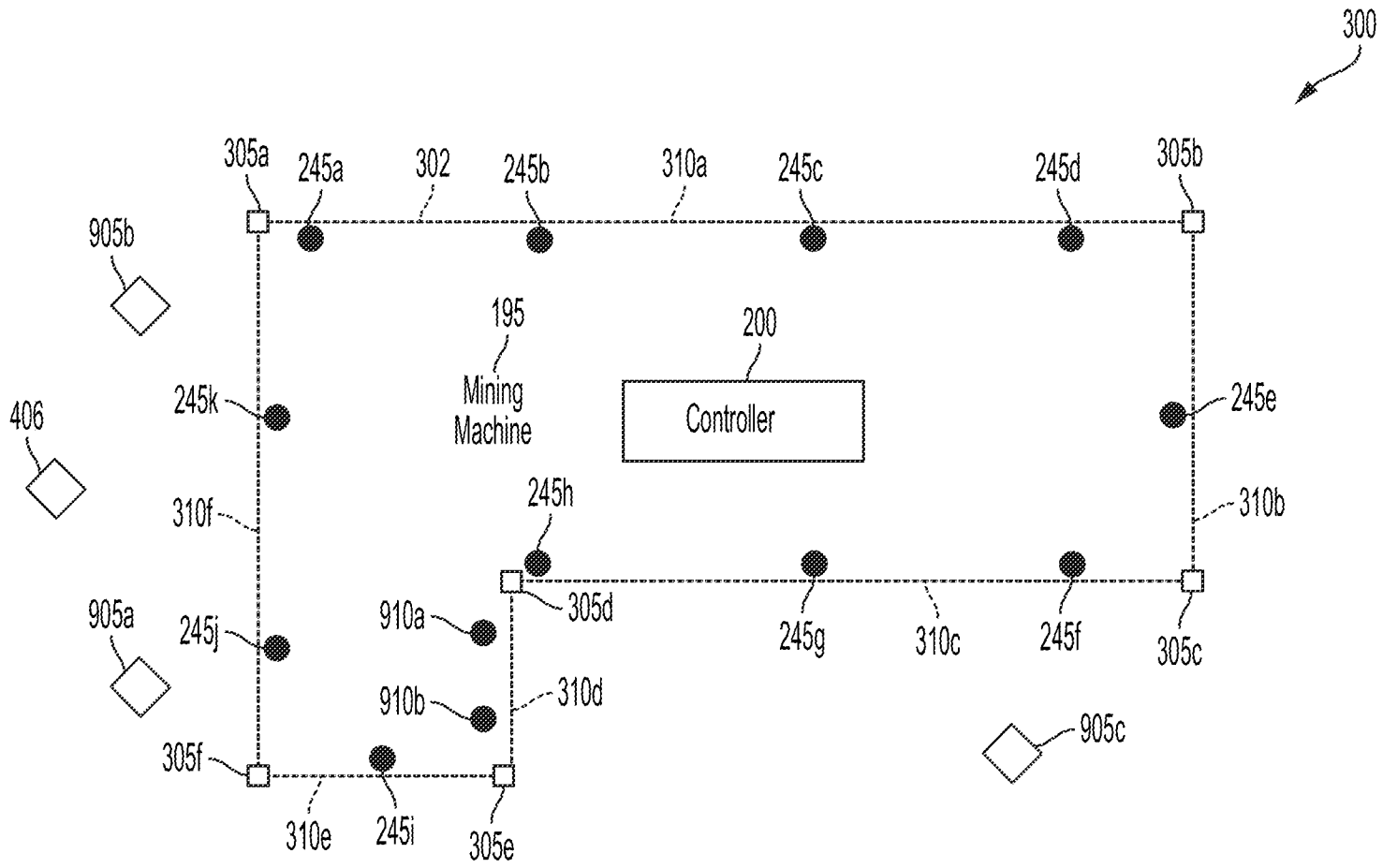
FIG. 9A illustrates multiple objects detected within the vicinity of a mining machine, according to some embodiments.

Turning to FIG. 8C, in step 830, after the electronic processor 250 determines that the second object is closest to a second light source of the plurality of light sources on the first segment than the first object, the electronic processor 250 controls the second light source to repeatedly flash. For example, as described above, the electronic processor 250 may send a command to the second light source (e.g., one of the sensor-lights 245) with one or more of an intensity parameter, color parameter, and frequency parameter to cause the second sensor-light to flash repeatedly. With reference to FIG. 9A assuming that the second object 905*b* is the second object being detected in the method 800, the electronic processor 250 determines that the second object 905*b* is closest to the sensor-light 245*k* and, in STEP 830, controls the sensor-light 245*k* to flash repeatedly. In some embodiments, the flash rate of the sensor-light 245*k* is set by the electronic processor 250 at a rate proportional to the distance between the second object 906*b* and the mining machine 195, using similar technique as described above with respect to the first object 406. See, for example, the graph 700 of FIG. 7 and related discussion regarding control of the flash rate based on distance of an object to the mining machine 195.

While controlling the sensor-light 245*k* to flash in STEP 830, the electronic processor 250 may continue to control the sensor-light 245*j* based on the first object 406 as described with respect to STEP 520 in FIG. 5. Accordingly, both sensor-lights 245*j* and 245*k* may be controlled to flash based on detecting separate objects (the objects 406 and 905*b*). Although the flashing of the sensor-lights 245*j* and 245*k* may be occurring in parallel (i.e., during overlapping time periods), the particular flash rate of each of the sensor-lights 245*j* and 245*k* may be controlled independently of one another based on the distance between their respective triggering objects (the object 406 for the sensor-light 245*j* and the object 905*b* for the sensor-light 245*k*). Accordingly, the electronic processor 250 may control the sensor-lights 245*j* and 245*k* to flash during the same or overlapping time periods, but with different flash rates, based on two objects 406, 905*b* being simultaneously present near the segment 310*f*.

Additionally, in STEP 845, the electronic processor 250 controls at least one other light source on the first segment to illuminate in a different manner than the closest light source, as previously described with respect STEP 525 of FIG. 5. With reference to FIG. 9A, the first segment is illustrated with only two sensor-lights 245 and each is being controlled to flash based on the first object 406 and the second object 905*b*, respectively. However, in some embodiments, a further sensor-light 245 is provided on the first segment 310*f* and that further sensor-light 245 is controlled in a manner different than the sensor-light 245*j* (based on STEP 525 of FIG. 5) and in a manner different than the sensor-light 245*k* (based on STEP 845). For example, the further sensor-light 245 may be controlled to illuminate steady-on. The electronic processor 250 then returns to STEP 805 of FIG. 8A to determine an updated position for the second object 905.

Returning to FIG. 8A, STEP 810, when the electronic processor 250 determines that the position of the second object 905 does not correspond to the first segment, the electronic processor 250 proceeds to STEP 850. For example, and with reference to FIG. 9A, when the second object 905 in this process 800 is the second object 905*c*, the electronic processor 250 determines that the position of the second object 905*c* does not correspond to the (first) segment 310.

Returning to FIG. 8A, in STEP 850, the electronic processor 250 determines whether the position of the second object 905 corresponds to a second segment of the perimeter 302. Similar to STEP 510 of FIG. 5, in some embodiments, the electronic processor 250 determines that the position of the second object 905 corresponds to a second segment when the electronic processor 250 determines that the position of the second object 905 is between two consecutive end points 305*a-f* of the virtual perimeter 302 and is adjacent the segment 310*a-f* joining those consecutive end points 305*a-f*. With reference to FIG. 9A and the example of the second object 905*c*, the electronic processor 250 determines that the second object 905*c* corresponds to the segment 310*c* (also referred to as the second segment 310*c*).

Returning to FIG. 8A, when the electronic processor 250 determines that the second object 905 does not correspond to a second segment of the perimeter 302 (e.g., the second object 905 is not between two consecutive end points 305*a-f* or is not adjacent to a segment), the electronic processor 250 returns to STEP 805. When the electronic processor 250 determines that the second object 905 corresponds to a second segment of the perimeter 302, the electronic processor 250 proceeds to STEP 855.

STEPS 855, 860, and 865 are similar to STEPS 515, 520, and 525 of FIG. 5, except that the second object and second segment (and associated sensor-lights 245) are involved rather than the first object and first segment (and associated sensor-lights 245). Accordingly, the more detailed description of STEPS 515, 520, and 525 and the actions of the ODS system 300 and electronic processor 250 are incorporated herein with respect to STEPS 855, 860, and 865 (substituting the second object for the first object and the second segment for the first segment). However, the STEPS 855, 860, and 865 will be briefly discussed with reference to the second object 905*c* and the second segment 310*c* shown in FIG. 9A. In STEP 855, the electronic processor 250 determines the closest light source on the second segment to the second object. With reference to FIG. 9A, the electronic processor 250 determines that the light-sensor 245*f* is the closest light source to the second object 905*c* because the second object 905*c* is closer to the light-sensor 245*f* than the light-sensors 245*g* and 245*h*.

Returning to FIG. 8A, in STEP 860, the electronic processor 250 controls the closest light source on the second segment to repeatedly flash. For example, with reference to FIG. 9A, the electronic processor 250 controls the light-sensor 245*f* to repeatedly flash. In some embodiments, the electronic processor 250 may control the light-sensor 245*f* with a flash rate determined based on the distance between the mining machine 195 and the second object 905*c*, using similar techniques as described above with respect to the first object 406.

Returning to FIG. 8A, in STEP 865, the electronic processor 250 controls at least one other light source on the second segment to illuminate in a different manner. For example, with reference to FIG. 9A, the electronic processor 250 controls the light-sensor 245*g*, the light-sensor 245*h*, or both the light-sensors 245*g* and 245*h* in a different manner than the light-sensor 245*f*. For example, the electronic processor 250 controls the light-sensor 245*g*, the light-sensor 245*h*, or both the light-sensors 245*g* and 245*h* to illuminate steady-on.

In some embodiments, the electronic processor 250 may determine that an object corresponds to more than one segment of the perimeter 302. For example, with reference to FIG. 9A, additional sensor-lights 910*a-b* may be provided on segment 310*d*, where the sensor-lights 910*a-b* are each similar to the sensor-lights 245 in form and function. Further, when executing STEPS 505 and 510 of the method 500 of FIG. 5, the electronic processor 250 may determine that the position of the object 506*c* corresponds to both the segment 310*c* and the segment 310*d* because, for example, (i) the object 506*c* is adjacent to both segments 310*c* and 310*d* and (ii) the object 506*c* is between the endpoints 305*c* and 305*d* of the segment 310*c* and is between the endpoints 305*d* and 305*e* of the segment 310*d*. In such cases, the electronic processor 250 may proceed to implement STEPS 515, 520, and 525 with respect to each segment 310*c* and 310*d* (independently of one another) such that the closest sensor-light 245*a-k* on the segment 310*c* is controlled to flash and the closest sensor-light 910*a-b* on the segment 310*d* is controlled to flash, and other sensor-lights on the segments 310*c* and 310*d* are controlled in a different manner.

Although the detection and feedback techniques of FIGS. 5-9 have been described with respect to particular segments of the perimeter 302 and particular locations of objects 406 and 905, as should be apparent, at least in some embodiments, the detection and feedback techniques apply regardless of the segment of the perimeter 302 to which an object corresponds. Accordingly, at least in some embodiments, regardless of the angle of approach or position of an object to the mining machine 195, the ODS system 300 is configured to detect the object and to provide visual feedback to or towards the object that indicates both a corresponding segment of the mining machine 195, the sensor-light 245 that is closest to the object, and (in some instances) an indication of the distance between the object and the mining machine 195. Further, at least in some embodiments, the electronic processor 250 is configured to monitor for objects in respective areas corresponding to each segment of the perimeter and, in response to detecting an object in one or more of the areas, the electronic processor 250 is configured to give visual feedback to or towards the object using sensor-lights 245 on the segment (or segments) corresponding to the object (or objects) detected.

Figure 9B:
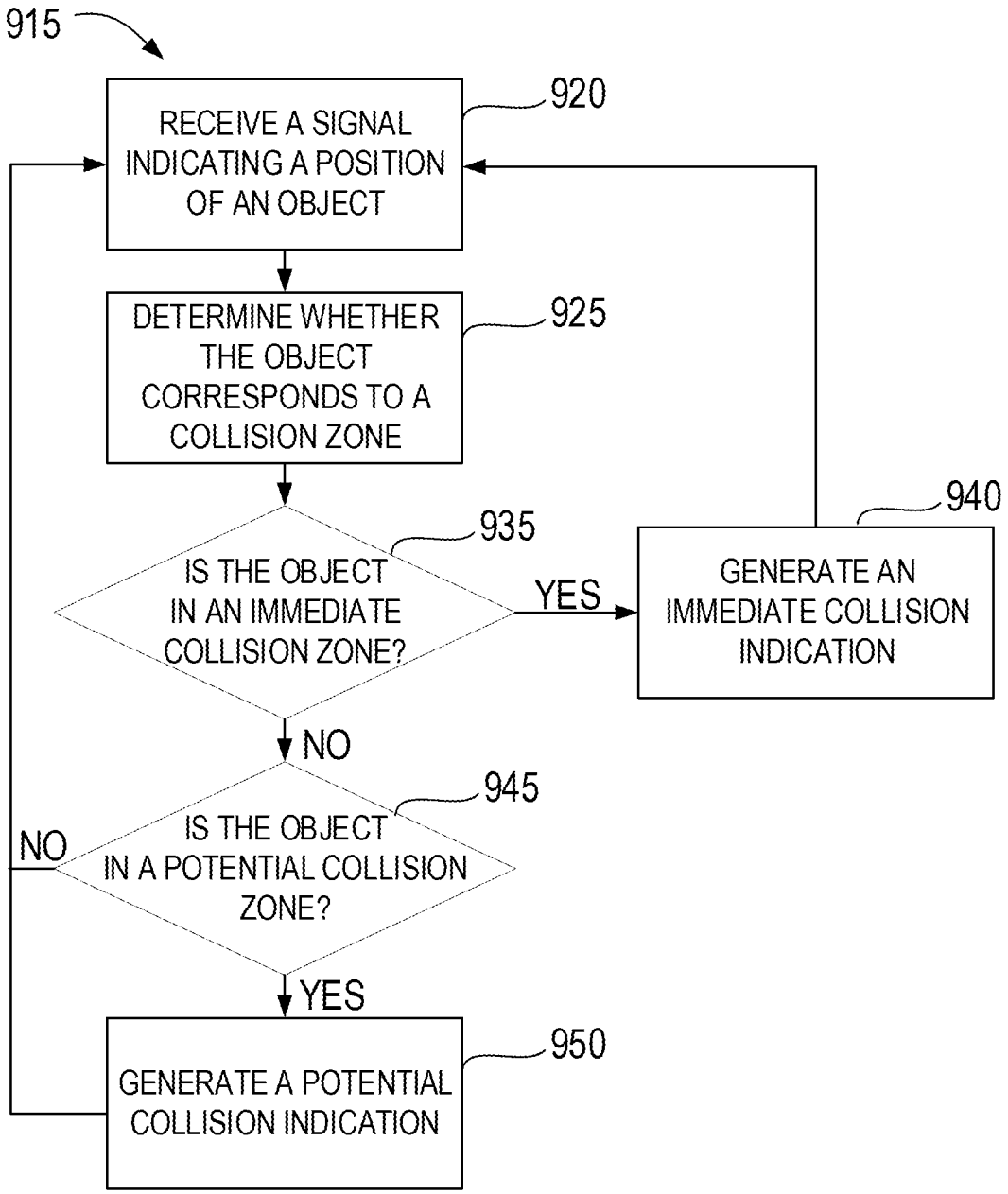
FIG. 9B is a flow chart for a general method for detecting an object within the vicinity of a mining machine, according to some embodiments.

FIG. 9B illustrates a general method 915 for detecting an object within the vicinity of a mining machine 195. The method 915 includes receiving a signal indicating a position of an object (STEP 920). The signal may be received by one or more proximity detectors of the mining machine 195. The method 915 also includes determining whether the object corresponds to one or more collision zone. In some embodiments, this may include determining whether the object corresponds to one or more segments of a plurality of segments which make up a perimeter of the mining machine 195 (STEP 925). Each of the segments may be a straight segment of the perimeter of the mining machine 195 between two vertices of the perimeter of the mining machine 195 (e.g., segment 310*a* between the vertices 305*a* and 305*b*, as seen in FIG. 9A). Each segment may have one or more indicators associated with the segment (e.g., the light sources 245*a-d* are associated with segment 310*a*, as seen in FIG. 9A). In some embodiments, the indicators may be a component other than a light source 345, such as a different type of light source, a buzzer, and the like.

The method 915 also includes determining whether the object is in an immediate collision zone of a plurality of immediate collision zones of the mining machine 195 (STEP 935). The method 915 may determine that the object is in an immediate collision zone if the object corresponds to exactly one segment. If the object corresponds to an immediate collision zone, the method 915 includes generating an indication indicating that the object is in the immediate collision zone (STEP 940). Generating the indication may include illuminating one light source of the plurality of light sources associated with the corresponding segment. The method 915 may then return to STEP 920.

Returning to STEP 935, if the object does not correspond to an immediate collision zone, the method 915 includes determining whether the object is in a potential collision zone of a plurality of potential collision zones of the mining machine 195 (STEP 945). The method 915 may determine that the object is in a potential collision zone if the object corresponds to two or more consecutive segments. If the object corresponds to a potential collision zone, the method 915 includes generating an indication indicating that the object is in the potential collision zone (STEP 950). Generating the indication may include illuminating at least one light source of each of the plurality of light sources associated with the corresponding segments. The method 915 may then return to STEP 920. Returning to STEP 945, if the object does not correspond to a potential collision zone, the method 915 mat return to STEP 920. As can be seen by the method 915, generating an indication that the object is in an immediate collision zone may have a higher priority than generating an indication that the object is in a potential collision zone.

Figure 10:
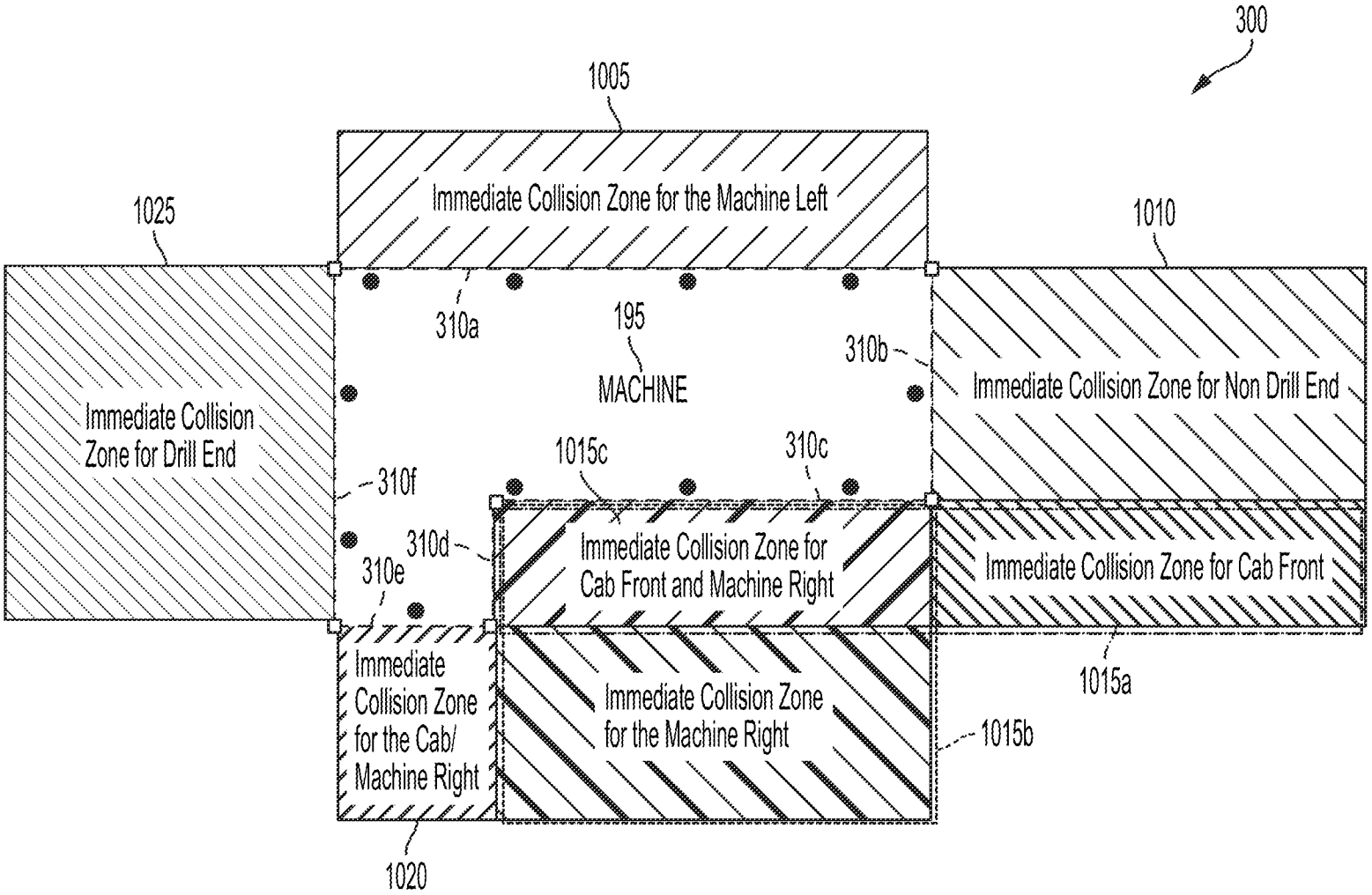
FIG. 10 illustrates immediate collision zones of a mining machine, according to some embodiments.

FIG. 10 illustrates immediate collision zones of the mining machine 195 in which objects may be detected by the ODS 300, according to some embodiments. The immediate collisions zones may be comprised of a first immediate collision zone 1005 for the left side of the mining machine 195; a second immediate collision zone 1010 for the non-tool end of the mining machine 195 (e.g., the non-drill end of a blasthole drill); a third immediate collision zone 1015*a* for the front of the operator's cab of the mining machine 195; a fourth immediate collision zone 1015*b* for the right side of the mining machine 195; a fifth immediate collision zone 1020 for the right side on the operator's cab of the mining machine 195 and the right side of the mining machine 195; and a sixth immediate collision zone 1025 for the tool end of the mining machine 195 (e.g., the drill end of a blasthole drill).

As shown, each of the immediate collision zones is adjacent to at least one of the segments 310*a*-310*f*. In other words, each immediate collision zone includes a boundary that abuts and runs parallel to one of the segments 310*a*-310*f*. Accordingly, each immediate collision zone may be referred to as being associated with a segment of the segments 310*a*-310. For example, the immediate collision zone 1005 is associated with the segment 310*a*. In some instances, immediate collision zones may overlap, such as the third and fourth immediate collision zones 1015*a-b*, and an overlapping portion 1015*c* of the overlapping collision zones 1015*a-b* may be adjacent to two of the segments (e.g., segments 310*c* and 310*d*). In some embodiments, the overlapping portion 1015*c* may be referred to as an immediate collision zone 1015*c* that is adjacent to the segments 310*c* and 310*d*.

Figure 11:
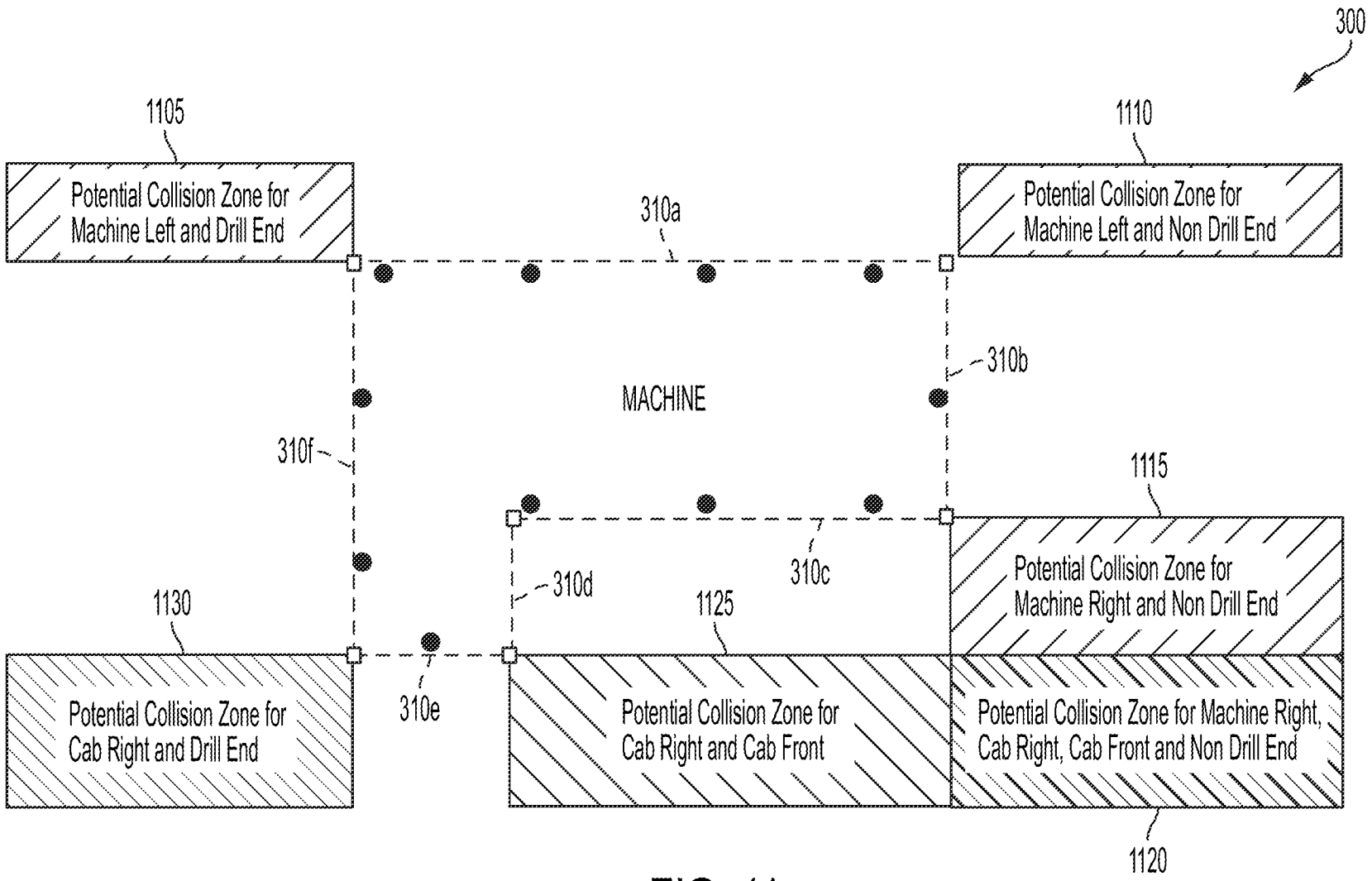
FIG. 11 illustrates potential collision zones of a mining machine, according to some embodiments.

FIG. 11 illustrates potential collision zones of the mining machine 195 in which objects may be detected by the ODS 300, according to some embodiments. For example, the potential collision zones may be positioned at a corner of the of the mining machine between two immediate collision zones. In other words, while the immediate collision zones are generally located adjacent the mining machine (or adjacent a segment of the virtual perimeter), the potential collision zones are not positioned adjacent the mining machine. Rather, the potential collision zones are located at an angle from one of the corners of the mining machine. The potential collision zones are therefore positioned between two immediate collision zones. More particularly, in FIG. 11, a first potential collision 1105 is located left of the mining machine 195 at the drill end of the mining machine 195. A second potential collision zone 1110 is located left of the mining machine 195 at the non-drill end of the mining machine 195. A third potential collision zone 1115 is located right of the mining machine at the non-drill end of the mining machine 195. A fourth potential collision zone 1120 is located right of the mining machine 195, in front of the operator's cab of the mining machine 195, and at the non-drill end of the mining machine 195. A fifth potential collision zone 1125 is located right of the operator's cab of the mining machine 195 and in front of the operator's cab of the mining machine 195. A sixth potential collision zone 1130 is located right of the operator's cab of the mining machine 195, behind the operator's cab of the mining machine 195, and at the drill end of the mining machine 195.

As is apparent from FIGS. 10 and 11, the potential collision zones and immediate collision zones are mostly non-overlapping, complementary collision zones (i.e., except for potential collision zones 1115, 1125 and immediate collision zones 1015*a-b*) that wrap around mining machine 195 along and external to the virtual perimeter 302. As shown in FIGS. 10 and 11 when viewed together or overlaid on one another, each of the potential collision zones is adjacent at least two of the immediate collision zones or, in the case of the fourth potential collision zone 1120, at least two other potential collision zones (potential collision zones 1115 and 1125) and at least two immediate collision zones (immediate collision zones 1015*a*, 1015*b*). Similarly, each immediate collision zone is adjacent to two of the potential collision zones (e.g., immediate collision zone 1010 is adjacent to potential collision zones 1110 and 1115). In addition to being described as adjacent to one another, the various adjacent zones may also be described as having a common boundary with one another. For example, the immediate collision zone 1010 has a common boundary with the potential collision zone 1110 and another common boundary with the potential collision zone 1115.

Furthermore, the immediate collision zones and potential collision zones may each have different sizes, which may be predefined sizes. The immediate and potential collision zones of the mining machine 195 may be defined and stored in, for example, the memory 255 of the controller 200. For example, the immediate and potential collision zones may be defined as areas using two-dimensional coordinates as part of the two-dimensional coordinate map for the mining machine 195 previously described, where the origin of the coordinate map may be selected, for example, as a central point within the mining machine 195.

Figure 12:
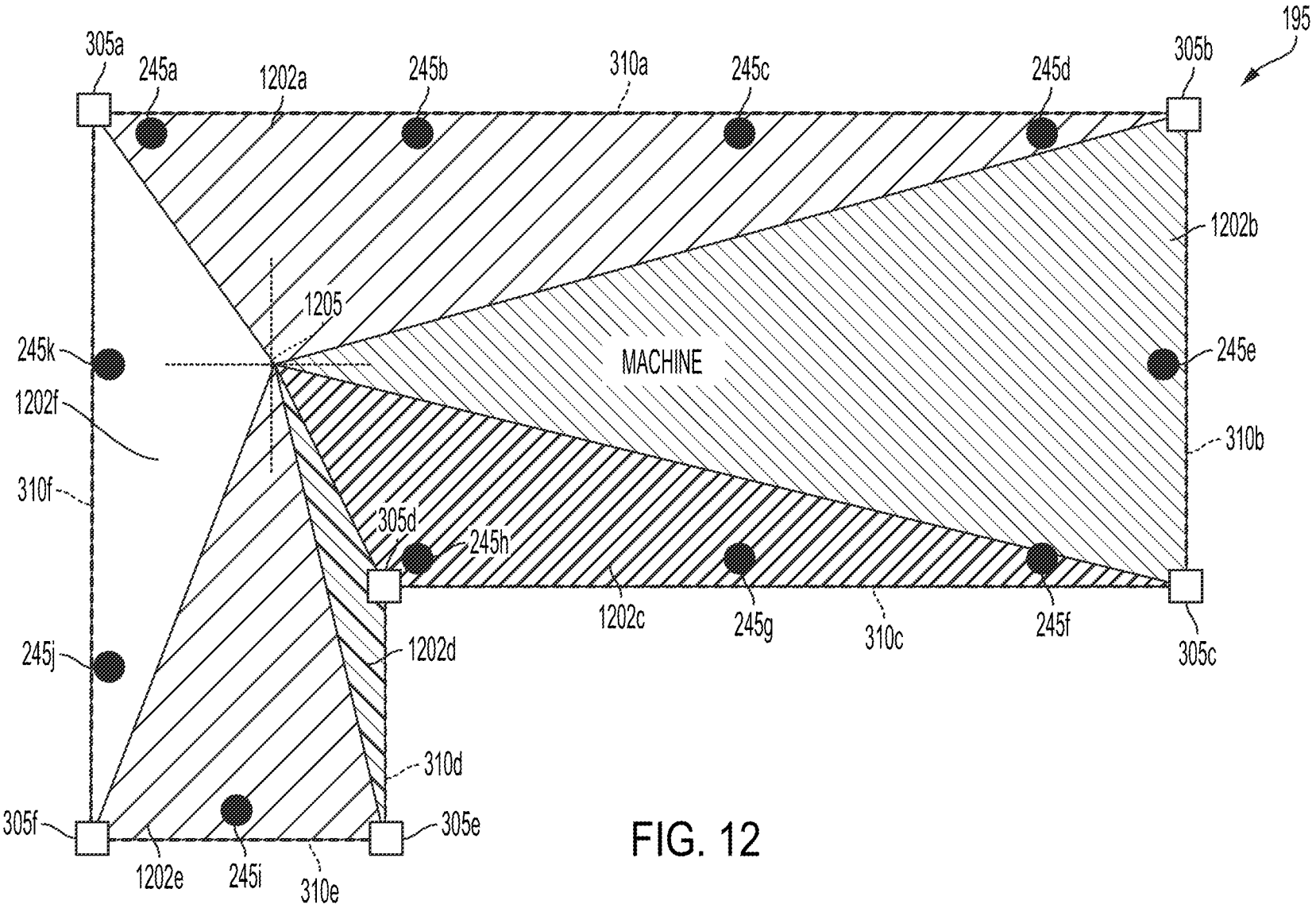
FIG. 12 illustrates a diagram of a mining machine including virtual triangles defined by a reference point and perimeter segments of the mining machine, according to some embodiments.

In addition to defining immediate collision zones and potential collision zones, the controller 120 also defines one or more virtual triangles 1202*a-f*, each of the virtual triangles being associated with one of the segments 310*a*-310*f*. An example of these virtual triangles is illustrated in FIG. 12. Each of the virtual triangles is calculated based on the endpoints of each of the segments 310*a*-310*f* with reference to a reference point 1205 of the mining machine 195. The reference point 1205 may be, for example, an origin point (0,0) on the two-dimensional coordinate map for the mining machine 195. More particularly, each virtual triangle 1202*a-f* is formed by one of the segments 310*a-f* and respective lines connecting the two end points of the one of the segments 310*a-f* to the reference point 1205. For example, the virtual triangle 1202*a* is defined by the segment 310*a*, a line connecting endpoint 305*a* to reference point 1205, and a line connecting endpoint 305*b* to reference point 1205. In some embodiments, the virtual triangles are stored in memory 255 and, similar to the collision zones of FIGS. 10 and 11, may be defined as areas using two-dimensional coordinates on the two-dimensional coordinate map for the mining machine 195.

Figure 13:
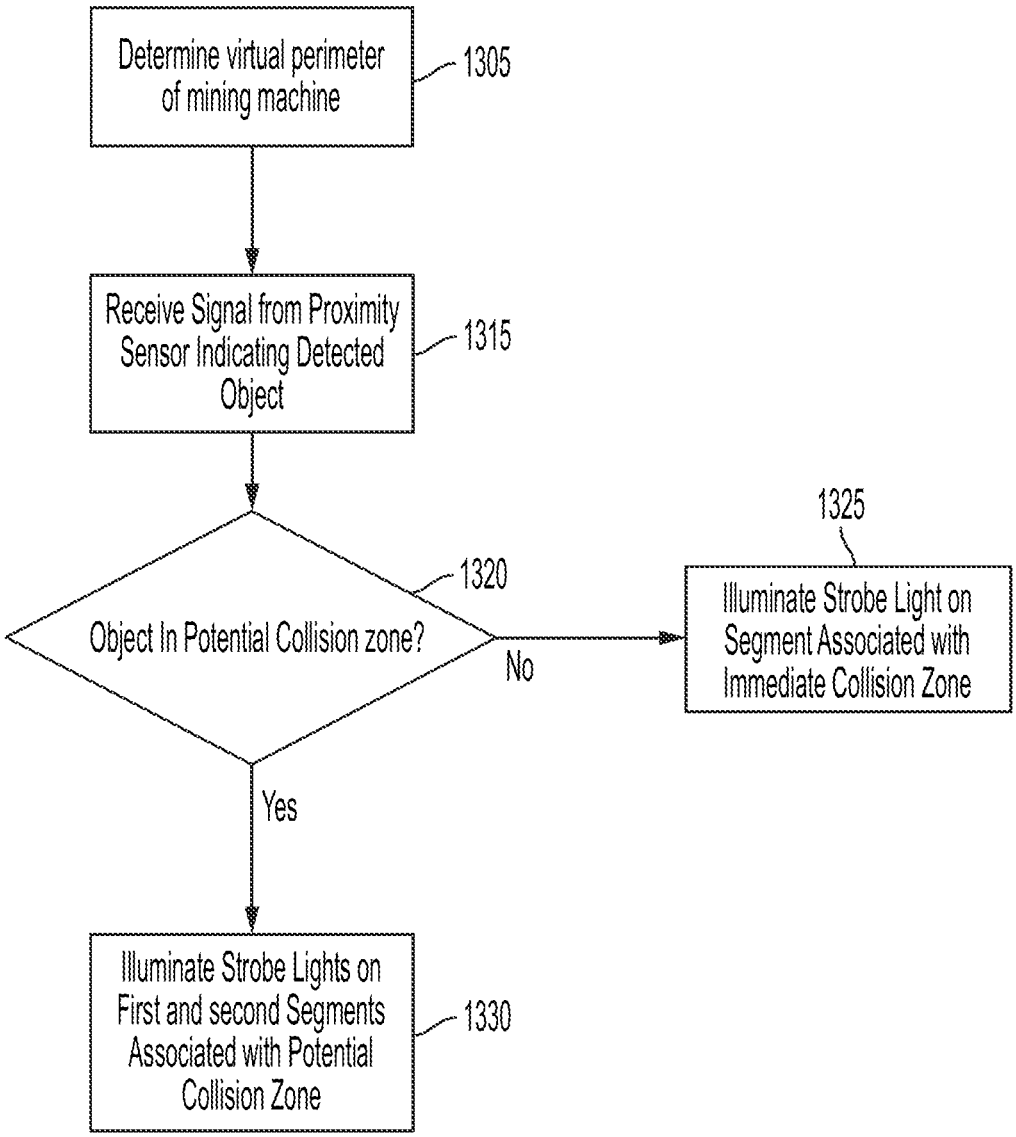
FIG. 13 illustrates a method for detecting an object in an immediate collision zone or potential collision zone, according to some embodiments.

FIG. 13 illustrates a method 1300 of the ODS system 300 for detecting an object in an immediate collision zone or potential collision zone of the mining machine 195 according to some embodiments. Although the method 1300 is described with respect to the ODS system 300 and the mining machine 195, the method 1300 may also be implemented by other systems and mining machines.

The method 1300 includes determining, by the electronic processor 250 of the mining machine 195, the virtual perimeter 302 of the mining machine 195 (block 1305). The virtual perimeter 302, as previously described, may be defined in terms of a plurality of segments 310*a*-310*f*, each segment connecting two consecutive end points 305*a*-305*f*. In some embodiments, the virtual perimeter 302 is defined in terms of coordinates (e.g., representing the end points 305*a*-305*f*) stored in the memory 255 and is determined by the electronic processor 250 accessing the memory 255 to retrieve the coordinates. In some embodiments, the electronic processor 250 determines the virtual perimeter 302 by receiving coordinates of the virtual perimeter from a remote computing device in communication with the electronic processor 250 (for example, during a setup process).

The method 1300 further includes receiving, by the electronic processor 250, a signal from a proximity sensor, such as a proximity sensor 295 of one of the sensor-lights 245, indicating detection of an object in the vicinity of the mining machine 195 (block 1315). For example, as previously described with reference to FIG. 6A, the signal may indicate the distance of the object from the sensor-light 245, and angle of the object with respect to a line normal to the segment on which the sensor-light 245 is located, and an identity of the sensor-light 245. From this information, the electronic processor 250 is configured to determine the location of the object on a coordinate map for the mining machine 195. For example, as previously described with respect to FIG. 6A, the electronic processor 250 has access to the two-dimensional coordinate map for the mining machine 195 that includes the positions of the end points 305, the segments 310, and the sensor-lights 245, the electronic processor 250 is configured to use conventional trigonometric principles to translate the obstacle data from each of the sensor-lights 245 to a two-dimensional coordinate position for the object on the two-dimensional coordinate map (which may have the reference point 1205 as the origin point (0,0) of the coordinate map).

In block 1320, the electronic processor 250 then determines, based on the signal, whether the object is in one of the potential collision zones. In some embodiments, to determine whether the object is in one of the potential collision zones, the electronic processor 250 determines whether object virtual triangles drawn from the determined object position to end points 305*a*-305*f* of each segment 310*a*-310*f* intersect with one of the virtual triangles 120*a*-1202*f*.

Figure 14A:
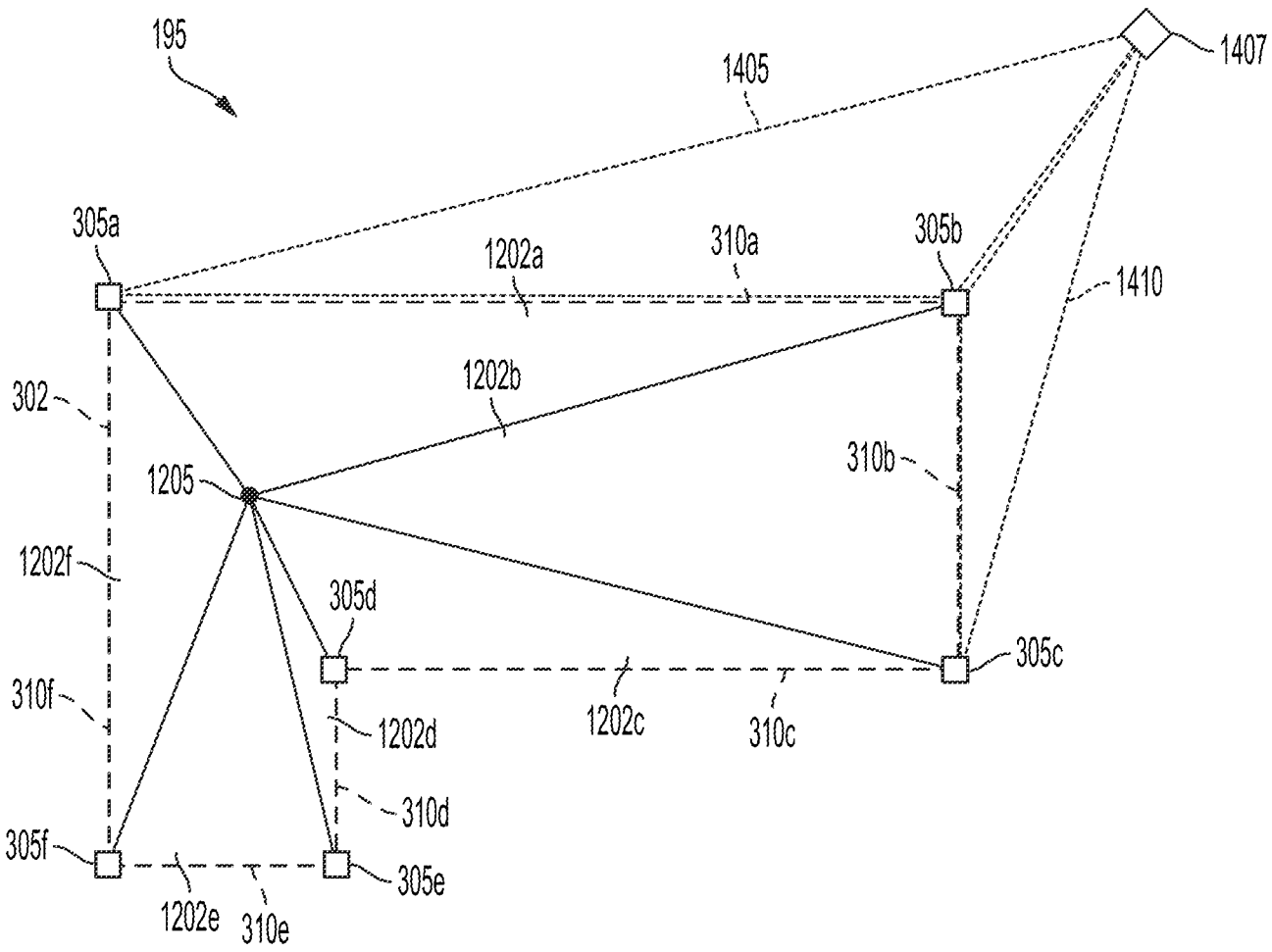
FIGS. 14A-D provide diagrams illustrating a technique to determine whether an object is in a potential collision zone of a mining machine, according to some embodiments.
Figure 14B:
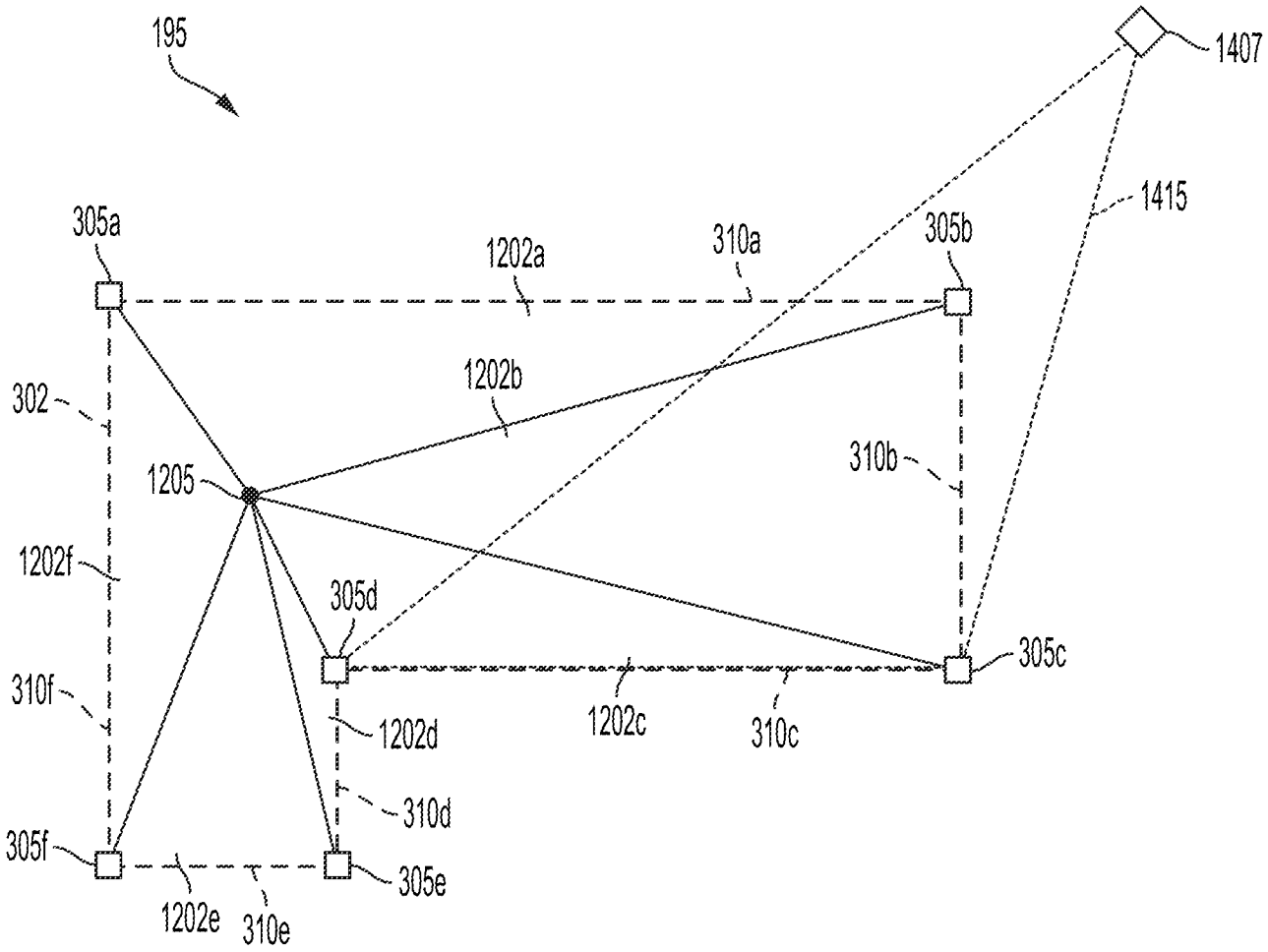
Figure 14C:
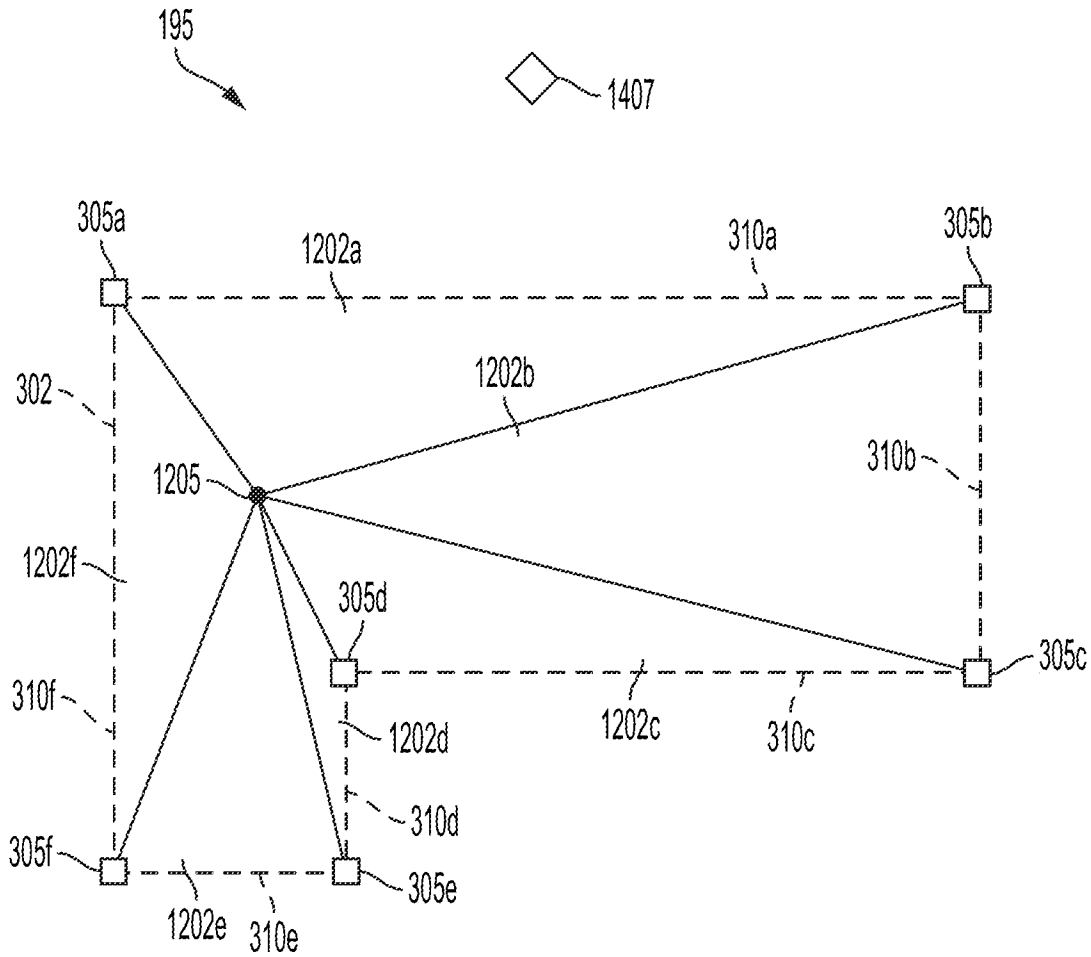

This determination technique is further illustrated with reference to FIGS. 14A-D. In FIG. 14A, an object virtual triangle 1405 is drawn from object 1407 to the endpoints 305*a* and 305*b* of segment 310*a*. The object virtual triangle 1405 does not intersect any of the virtual triangles 1202*a*-1202*f* defined inside the virtual perimeter 302 of the mining machine 195. Accordingly, the electronic processor 250 concludes that the object 1407 may potentially collide with segment 310*a* of the mining machine 195. Similarly, a second object virtual triangle 1410 is drawn from object 1407 to the endpoints 305*b* and 305*c* of the segment 310*b*. The second object virtual triangle 1410 does not intersect any of the virtual triangles 1202*a*-1202*f* defined inside the virtual perimeter 302 of the mining machine 195. Accordingly, the electronic processor 250 concludes that the object 1407 may potentially collide with segment 310*b* of the mining machine 195. Turning to FIG. 14B, a third object virtual triangle 1415 is drawn from object 1407 to the endpoints 305*c* and 305*d* of the segment 310*c*. The third object virtual triangle 1415 intersects with the virtual triangles 1202*a*, 1202*b*, and 1202*c* of the mining machine 195. Accordingly, the electronic processor 250 concludes that the object 1407 is not going to potentially collide with the segment 310*c* of the mining machine 195. Further object virtual triangles (not shown) are drawn from the object 1407 to the respective end points of segments 310*d*, 310*e*, 310*f* and each is determined to intersect with at least one virtual triangle 1202*a*-1202*f* Accordingly, like the third object virtual triangle 1415, the electronic processor 250 concludes that the object 1407 is not going to potentially collide with the segments 310*d*, 310*e*, or 310*f* of the mining machine 195.

In some embodiments, the electronic processor 250 determines that the object 1407 is in a potential collision zone when (a) the electronic processor 250 identifies at least one segment with which the object 1407 may potentially collide (using the aforementioned overlapping triangle process) and (b) the electronic processor 250 determines that the object 1407 is not adjacent to at least one of the segment(s) with which the object 1407 may potentially collide. For example, with reference to FIG. 14A, the electronic processor 250 determined that the object 1407 may potentially collide with segment 310*a* and 310*b*. Additionally, using a similar technique as described with respect to step 510 of FIG. 5, the electronic processor 250 may determine that the object 1407 is not adjacent to segment 310*a* or the segment 310*b*. For example, the electronic processor 250 determines that the position of the object 1407 is not between (i.e., it is outside of) the two consecutive end points 305*a*-*b* defining the segment 310*a* and is not between the two consecutive end points 305*b*-*c* defining the segment 310*b*. Accordingly, the electronic processor 250 deduces that the object 1407 is in a potential collision zone.

In contrast, the electronic processor 250 would not determine that an object 1409 is in a potential collision zone because, although the electronic processor 250 would identify at least one segment with which the object 1407 may potentially collide (segment 310) using the above-described overlapping triangle process, the object 1407 is adjacent to the segment. That is, the electronic processor 250 would determine that the position of the object 1409 is between (i.e., it is inside of) the two consecutive end points 305*a*-*b* defining the segment 310*a* (and, as an optional additional condition, within a predetermined distance of the segment). As the object 1409 is determined to be adjacent to the only segment identified as potentially colliding with the object 1409, the electronic processor 250 deduces that the object 1407 is not in a potential collision zone.

Figure 14D:
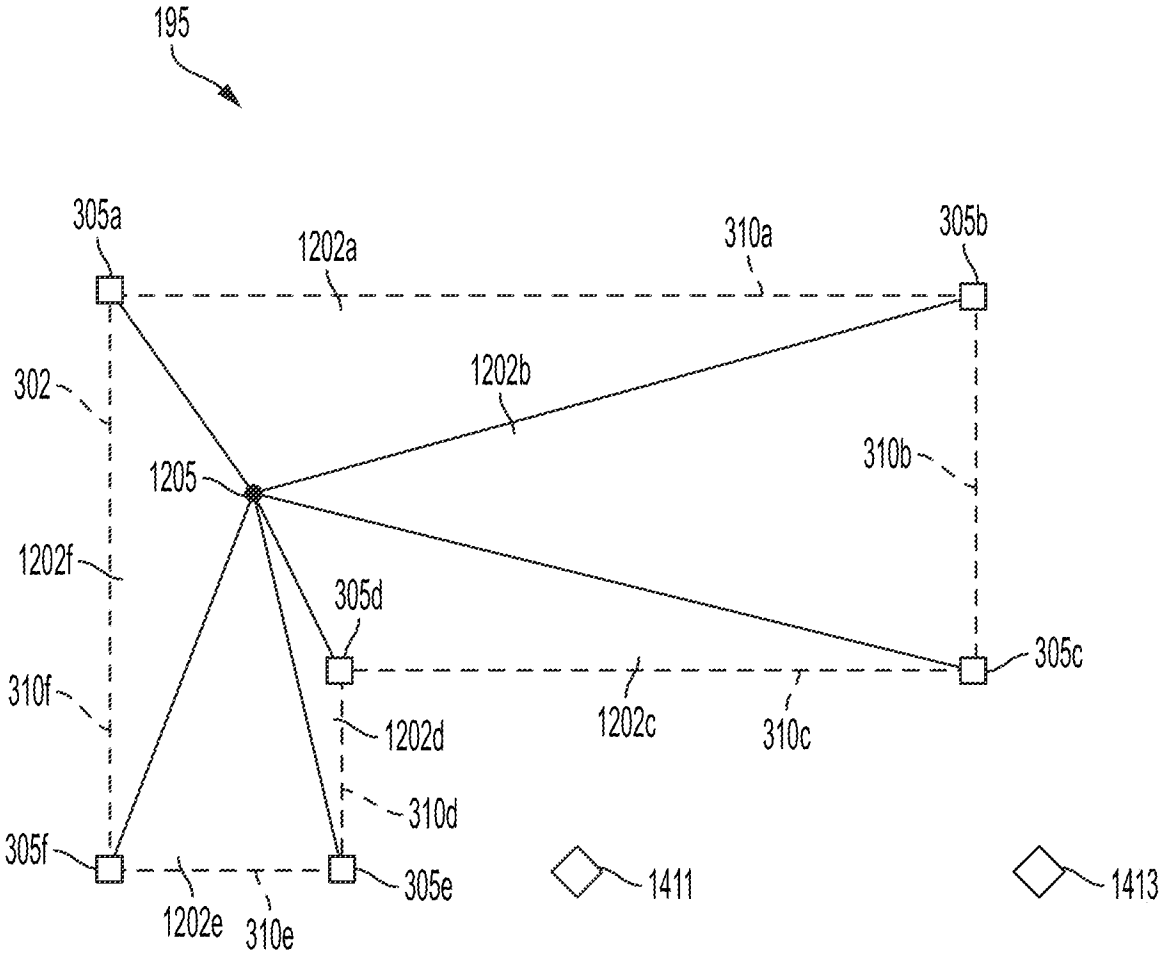

With reference to FIG. 14D, the electronic processor 250 would determine that an object 1411 may potentially collide with segment 310*c*, 310*d*, and 310*e* using the aforementioned overlapping triangle technique to detect whether object virtual triangles from the object 1411 overlap with virtual triangles 1202*a*-*f*. In this instance, the electronic processor 250 determines that the position of the object 1411 is outside of the end points 305*e*-*f* defining the segment 310*e* and outside of the end points 305*d*-*e* defining segment 310*d*. Accordingly, the electronic processor 250 determines that the object 1411 is in a potential collision zone at least for this reason. Additionally, the electronic processor 250 may determine that the object 1411 is adjacent to the segment 310*c* because the object 1411 is within the end points 305*c*-*d*. Nevertheless, the object 1411 is still considered in a potential collision zone associated with segments 310*d* and 310*e*.

In some embodiments, the electronic processor 250 may further determine that the object 1411 is in the immediate collision zone 1015*b* (see FIG. 10). In this instance, the electronic processor 250 will determine that the object 1411 is both in a potential collision zone (zone 1125) and in an immediate collision zone (zone 1015).

With continued reference to FIG. 14D, the electronic processor 250 would determine that an object 1413 may potentially collide with segment 310*b*, 310*c*, 310*d*, and 310*e* using the aforementioned overlapping triangle technique to detect whether object virtual triangles from the object 1411 overlap with virtual triangles 1202*a*-*f*. In this instance, the electronic processor 250 would determine that the position of the object 1411 is outside of the end points 305*b*-*c* defining the segment 310*b*, outside of the end points 305*c*-*d* defining segment 310*c*, outside of the end points 305*d*-*e* defining segment 310*d*, and outside of the end points 305*e*-*f* defining segment 310*e*. Accordingly, the electronic processor 250 would determine that the object 1411 is in a potential collision zone.

In some embodiments, an additional distance condition is used such that, when the object is more than a threshold distance from the sensor-light 245, the object is determined to not be in a collision zone, whether potential collision zone or immediate collision zone. Similarly, when the object is within the threshold distance from the sensor-light 245, the object is in a collision zone of the mining machine 195, either a potential collision zone or an immediate collision zone.

In some embodiments, techniques other than the triangle-based technique described above are used to determine whether an object is within a potential or immediate collision zone of the mining machine 195. For example, in some embodiments, the potential and immediate collision zones are defined as bounded areas on the mining machine two-dimensional coordinate map in a setup stage. For example, each potential and immediate collision zone may be defined in terms of an upper and lower boundary in each dimension (e.g., lower x-dimension boundary, upper x-dimension boundary, lower y-dimension boundary, upper y-dimension boundary). Then, the electronic processor 250 determines whether an object is within one of the zones based on, for example, comparing the calculated two-dimensional (x,y) position of the object to the boundaries of the zones. When the calculated position is, for example, less than a maximum boundary and more than a minimum boundary (in both x and y dimensions of the two-dimensional coordinate map) for one of the defined potential or immediate collision zones, the electronic processor 250 determines that the object is in that collision zone.

Regardless of the particular technique used, when the electronic processor 250 determines that the object is not in a potential collision zone, the electronic processor 250 may exit the method 1300 or, as illustrated in FIG. 13, may conclude that the object is in an immediate collision zone and proceed to block 1325. For example, as discussed above, the electronic processor 250 may determine that the object 1407 (FIG. 14C) and, in some instances, the object 1409 (FIG. 14D) are each in a respective immediate collision zone. In block 1325, when the electronic processor 250 determines that the object is in one of the immediate collision zones of the mining machine 195, the electronic processor 250 illuminates at least a first sensor-light 245 on a segment of the plurality of segments 310*a*-310*f* associated with the immediate collision zone (e.g., segments to which the object is adjacent). In some embodiments, when the electronic processor 250 determines that the object is in one of the immediate collision zones of the mining machine 195, the electronic processor 250 illuminates sensor-lights 245 on the segment associated with the immediate collision zone in a manner described above with regards to FIG. 5, such that the closest sensor-light 245 is flashed, while one or more other sensor-lights 245 on the segment are controlled to illuminate in a different manner.

Returning back to decision block 1320 of FIG. 13, when the electronic processor 250 determines that the object is in one of the potential collision zones, the electronic processor 250 proceeds to block 1330. In block 1330, the electronic processor 250 illuminates at least a first strobe light on each segment associated with the potential collision zone. For example, in some embodiments, in response to identifying an object in a potential collision zone, the electronic processor 250 illuminates at least a first strobe light on each segment with which the electronic processor 250 determines a detected object may potentially collide (e.g., using the overlapping triangle technique), except those segments to which the object is adjacent. The strobe lights on segments to which the object is adjacent may be separately controlled to illuminate on account of the object being in an immediate collision zone associated with such segments. As a result, for example, a first segment associated with the potential collision zone of the plurality of segments (e.g., a segment associated with an immediate collision zone that adjoins the potential collision zone) and at least a second strobe light along a second segment associated with the potential collision zone of the plurality of segments (e.g., a segment associated with another immediate collision zone that adjoins the potential collision zone). For example, with reference to FIGS. 14A-B, the electronic processor 250 would illuminate one or more sensor-lights 245 on the segment 310*a* and one or more sensor-lights 245 on the segment 310*b*. As additional examples, with reference to FIG. 14D, the electronic processor 250 would illuminate (a) one or more sensor-lights 245 on the segment 310*d* and one or more sensor-lights 245 on the segment 310*e* in response to determining that the object 1411 is in the potential collision zone 1125 and (b) one or more sensor-lights 245 on each of the segments 310*b*, 310*c*, 310*d*, and 310*e* in response to determining that the object 1411 is in the potential collision zone 1120. In some embodiments, the electronic processor 250 illuminates all of the sensor-lights 245 on the segments associated with the potential collision zone in which the object is located. Segments associated with each potential collision zone may be stored in the memory 255 in advance (e.g., in a setup stage) or may be determined using the overlapping triangle technique described above, where segments 310*a-f* that are not adjacent to the object and that are used to define object virtual triangles that do not overlap with virtual triangles 1202*a-f* are considered associated segments. The electronic processor 240 may illuminate the one or more sensor-lights 245 on the first segment and on the second segment constantly (e.g., turned on and left on), flashed, or in some other manner. Accordingly, in some embodiments, the electronic processor 250 illuminates at least one of the sensor-lights 245 on two or more segments 310 of the mining machine 195 when the object is in a potential collision zone.

Accordingly, embodiments described herein provide systems and methods for detecting objects in the vicinity of a mining machine and providing visual feedback directed towards the objects in accordance with the present disclosure or may take any one or more of the following configurations.

(1) A system for detecting a potential collision between an object and a mining machine, the system comprising: a sensor, a first strobe light and a second strobe light, and an electronic processor configured to identify a virtual perimeter around at least a portion of the mining machine, identify a plurality of collision zones, the plurality of collision zones including at least one immediate collision zone and at least one potential collision zone, receive a signal from a sensor indicating detection of the object in one of the plurality of collision zones, determine, based on the signal, whether the object is in the immediate collision zone or the potential collision zone, generate, in response to determining that the object is in the potential collision zone, a first indication, and generate, in response to determining that the object is in the immediate collision zone, a second indication different than the first indication.

(2) The system 1, wherein generating at least one of the first indication and the second indication includes controlling a light to do at least one selected from the group consisting of adjust an intensity of the light, adjust a color of the light, and initiate a strobe function.

(3) The system of 2, wherein the electronic processor identifies the virtual perimeter by identifying a plurality of segments extending consecutively around the mining machine.

(4) The system of 3, wherein the electronic processor determines that the object is in the immediate collision zone by determining that the position of the object corresponds to a single segment of the virtual perimeter of the mining machine.

(5) The system of 3, wherein the electronic processor determines that the object is in the immediate collision zone by determining that the position of the object is between two lines extending away from the mining machine from two end points that define a first segment of the virtual perimeter.

(6) The system of 3, wherein the electronic processor determines that the object is in the potential collision zone by determining that the position of the object corresponds to two segments of the virtual perimeter of the mining machine.

(7) The system of 6, wherein the two segments are consecutive segments oriented in a non-parallel manner relative to one another.

(8) The system of 3, wherein the immediate collision zone is located adjacent to a segment of the mining machine.

(9) The system of 8, wherein the potential collision zone is located at a corner of the mining machine between two immediate collision zones.

(10) The system of 3, wherein each of the plurality of segments includes at least one indicator.

(11) The system of 10, wherein generating the first indication includes actuating an indicator on a first segment, and wherein generating the second indication includes actuating the first indicator on the first segment and a second indicator on a second segment.

(12) The system of 11, wherein the first indicator and the second indicator are lights.

(13) The system of 12, wherein generating the first indication includes controlling the first indicator to initiate a strobe function, and wherein generating the second indication includes controlling the first indicator to illuminate continuously.

(14) A method for detecting a collision risk between an object and a mining machine, the method comprising: identifying, by an electronic processor, a virtual perimeter around at least a portion of the mining machine; identifying, by the electronic processor, a plurality of collision zones, the plurality of collision zones including at least one immediate collision zone and at least one potential collision zone; receiving, by the electronic processor, a signal from a sensor indicating detection of the object in one of the plurality of collision zones; determining, by the electronic processor, based on the signal, whether the object is in the immediate collision zone or the potential collision zone; in response to determining that the object is in the potential collision zone, generating, by the electronic processor, a first indication; and in response to determining that the object is in the immediate collision zone, generating, by the electronic processor, a second indication different than the first indication.

(15) The method of 14, wherein identifying the virtual perimeter includes identifying a plurality of segments extending consecutively around the mining machine.

(16) The method of 15, wherein determining that the object is in the immediate collision zone includes determining that the position of the object corresponds to a single segment of the virtual perimeter of the mining machine.

(17) The method of 15, wherein determining that the object is in the potential collision zone includes determining that the position of the object corresponds to two segments of the virtual perimeter of the mining machine.

(18) The method of 15, wherein the immediate collision zone is located adjacent to a respective segment of the mining machine, and wherein the potential collision zone is located at a corner of the mining machine between two immediate collision zones.

(19) The method of 15, wherein generating the first indication includes actuating an indicator on a first segment, and wherein generating the second indication includes actuating the first indicator on the first segment and a second indicator on a second segment.

(20) The method of 19, wherein the first actuator and the second actuator are lights.

(21) The method of 14, wherein generating the first indication includes controlling the first indicator to initiate a strobe function, and wherein generating the second indication includes controlling the first indicator to illuminate continuously.

(22) A system for detecting an object within a vicinity of a mining machine, the system comprising: a sensor configured to secure to the mining machine; a first plurality of light sources configured to secure to the mining machine; and an electronic processor configured to: receive a signal from the sensor indicative of the object being positioned in the vicinity of the mining machine, determine that the position of the object corresponds to a first segment of a virtual perimeter extending at least partially around the mining machine, the first segment associated with the first plurality of light sources, identify a first light source of the first plurality of light sources that is closest to the object, control the first light source to repeatedly flash, and control a second light source of the first plurality of light sources to illuminate in a different manner than the first light source.

(23) The system of 22, wherein the mining machine is one of a rope shovel and a blasthole drill.

(24) The system of 22, wherein illuminating the second light in a different manner includes at least one selected from the group consisting of illuminating the second light source in a continuous manner, illuminating the second light source at a lower illumination that the first light source, and turning off the second light source.

(25) The system of 22, wherein the electronic processor determines that the position of the object corresponds to the first segment by determining that the position of the object is between two lines extending away from the mining machine from two end points that define the first segment of a virtual perimeter.

(26) The system of 22, wherein the first light source of the first plurality of light sources repeatedly flashes at a flash rate determined based on a distance between the object and the first segment.

(27) The system of 22, wherein the object that is detected is a first object and wherein the electronic processor is further configured to: receive a second signal from the sensor indicative of a second object being positioned in the vicinity of the mining machine, determine that the position of the second object corresponds to the first segment of the virtual perimeter, determine which of the first object and the second object is the closest object to the mining machine, determine which of the first plurality of light sources is closest light source to the closest object, and control the closest light source to repeatedly flash.

(28) The system of 22, wherein the object that is detected is a first object and wherein the electronic processor is further configured to: receive a second signal from the sensor indicative of a second object being positioned in the vicinity of the mining machine, determine that the position of the second object corresponds to the first segment of the virtual perimeter, determine that the second light source of the first plurality of light sources is closest to the second object, control the second light source to repeatedly flash based on a distance of the second object to the first segment, and control the first light source to repeatedly flash based on the distance of the first object to the first segment.

(29) The system of 28, wherein the electronic processor is further configured to control the at least one other light source of the first plurality of light sources to illuminate in a different manner than the second light source of the first plurality of light sources.

(30) The system of 22, wherein the object that is detected is a first object and wherein the electronic processor is further configured to: receive a second signal from the sensor indicative of a second object being positioned in the vicinity of the mining machine, determine that the position of the second object corresponds to a second segment of the virtual perimeter, the second segment associated with the second plurality of light sources, identify a first light source of the second plurality of light sources that is closest to the object, and control the first light source of the second plurality of light sources to repeatedly flash.

(31) The system of 30, wherein the first light source of the first plurality of light sources is flashing simultaneously with the first light source of the second plurality of light sources.

(32) A method for detecting an object within a vicinity of a mining machine, the method comprising: receiving, by an electronic processor, a signal from a sensor indicative of the object being positioned in the vicinity of the mining machine; determining, by the electronic processor, that the position of the object corresponds to a first segment of a virtual perimeter extending at least partially around the mining machine, the first segment associated with the first plurality of light sources; identifying, by the electronic processor, a first light source of the first plurality of light sources that is closest to the object; controlling, by the electronic processor, the first light source to repeatedly flash; and controlling, by the electronic processor, a second light source of the first plurality of light sources to illuminate in a different manner than the first light source.

(33) The method of 32, wherein illuminating the second light in a different manner includes at least one selected from the group consisting of illuminating the second light source in a continuous manner, illuminating the second light source at a lower illumination that the first light source, and turning off the second light source.

(34) The method of 32, wherein determining that the position of the object corresponds to the first segment includes determining that the position of the object is between two lines extending away from the mining machine from two end points that define the first segment of a virtual perimeter.

(35) The method of 32, wherein controlling the first light source to repeatedly flash includes controlling the rate of the flashing based on a distance between the object and the first segment.

(36) The method of 32, wherein the object that is detected is a first object and wherein the method further comprises receiving a second signal from the sensor indicative of a second object being positioned in the vicinity of the mining machine; determining that the position of the second object corresponds to the first segment of the virtual perimeter; determining which of the first object and the second object is the closest object to the mining machine; determining which of the first plurality of light sources is closest light source to the closest object; and controlling the closest light source to repeatedly flash.

(37) The method of 32, wherein the object that is detected is a first object and wherein the method further comprises receiving a second signal from the sensor indicative of a second object being positioned in the vicinity of the mining machine; determining that the position of the second object corresponds to the first segment of the virtual perimeter; determining that the second light source of the first plurality of light sources is closest to the second object; controlling the second light source to repeatedly flash based on a distance of the second object to the first segment; and controlling the first light source to repeatedly flash based on the distance of the first object to the first segment.

(38) The method of 37, wherein the method further includes controlling the at least one other light source of the first plurality of light sources to illuminate in a different manner than the second light source of the first plurality of light sources.

What is claimed is:

1. A system for detecting an object within a vicinity of a mining machine, the system comprising:

a sensor configured to secure to the mining machine;

a first plurality of light sources configured to secure to the mining machine; and an electronic processor configured to:

receive a signal from the sensor indicative of the object being positioned in the vicinity of the mining machine, determine that the position of the object corresponds to a first segment of a virtual perimeter extending at least partially around the mining machine, the first segment associated with the first plurality of light sources, identify a first light source of the first plurality of light sources that is closest to the object, control the first light source to repeatedly flash, control a second light source of the first plurality of light sources to illuminate in a different manner than the first light source, receive a second signal from the sensor indicative of a second object being positioned in the vicinity of the mining machine, determine that the position of the second object corresponds to the first segment of the virtual perimeter, determine which of the first object and the second object is the closest object to the mining machine, determine which of the first plurality of light sources is closest light source to the closest object, and control the closest light source to repeatedly flash.

2. The system of claim 1, wherein the mining machine is one of a rope shovel and a blasthole drill.

3. The system of claim 1, wherein illuminating the second light in a different manner includes at least one selected from the group consisting of illuminating the second light source in a continuous manner, illuminating the second light source at a lower illumination that the first light source, and turning off the second light source.

4. The system of claim 1, wherein the electronic processor determines that the position of the object corresponds to the first segment by determining that the position of the object is between two lines extending away from the mining machine from two end points that define the first segment of a virtual perimeter.

5. The system of claim 1, wherein the first light source of the first plurality of light sources repeatedly flashes at a flash rate determined based on a distance between the object and the first segment.

6. The system of claim 1, wherein the object that is detected is a first object and wherein the electronic processor is further configured to:

receive a second signal from the sensor indicative of a second object being positioned in the vicinity of the mining machine, determine that the position of the second object corresponds to the first segment of the virtual perimeter, determine that the second light source of the first plurality of light sources is closest to the second object, control the second light source to repeatedly flash based on a distance of the second object to the first segment, and control the first light source to repeatedly flash based on the distance of the first object to the first segment.

7. The system of claim 6, wherein the electronic processor is further configured to control the at least one other light source of the first plurality of light sources to illuminate in a different manner than the second light source of the first plurality of light sources.

8. The system of claim 1, wherein the object that is detected is a first object and wherein the electronic processor is further configured to:

receive a second signal from the sensor indicative of a second object being positioned in the vicinity of the mining machine, determine that the position of the second object corresponds to a second segment of the virtual perimeter, the second segment associated with the second plurality of light sources, identify a first light source of the second plurality of light sources that is closest to the object, and control the first light source of the second plurality of light sources to repeatedly flash.

9. The system of claim 8, wherein the first light source of the first plurality of light sources is flashing simultaneously with the first light source of the second plurality of light sources.

10. A method for detecting an object within a vicinity of a mining machine, the method comprising:

receiving, by an electronic processor, a signal from a sensor indicative of the object being positioned in the vicinity of the mining machine;

determining, by the electronic processor, that the position of the object corresponds to a first segment of a virtual perimeter extending at least partially around the mining machine, the first segment associated with the first plurality of light sources;

identifying, by the electronic processor, a first light source of the first plurality of light sources that is closest to the object;

controlling, by the electronic processor, the first light source to repeatedly flash;

controlling, by the electronic processor, a second light source of the first plurality of light sources to illuminate in a different manner than the first light source;

receiving a second signal from the sensor indicative of a second object being positioned in the vicinity of the mining machine;

determining that the position of the second object corresponds to the first segment of the virtual perimeter;

determining which of the first object and the second object is the closest object to the mining machine;

determining which of the first plurality of light sources is closest light source to the closest object; and controlling the closest light source to repeatedly flash.

11. The method of claim 10, wherein illuminating the second light in a different manner includes at least one selected from the group consisting of illuminating the second light source in a continuous manner, illuminating the second light source at a lower illumination that the first light source, and turning off the second light source.

12. The method of claim 10, wherein determining that the position of the object corresponds to the first segment includes determining that the position of the object is between two lines extending away from the mining machine from two end points that define the first segment of a virtual perimeter.

13. The method of claim 10, wherein controlling the first light source to repeatedly flash includes controlling the rate of the flashing based on a distance between the object and the first segment.

14. The method of claim 10, wherein the object that is detected is a first object and wherein the method further comprises receiving a second signal from the sensor indicative of a second object being positioned in the vicinity of the mining machine;

determining that the position of the second object corresponds to the first segment of the virtual perimeter;

determining that the second light source of the first plurality of light sources is closest to the second object;

controlling the second light source to repeatedly flash based on a distance of the second object to the first segment; and controlling the first light source to repeatedly flash based on the distance of the first object to the first segment.

15. The method of claim 14, wherein the method further includes controlling the at least one other light source of the first plurality of light sources to illuminate in a different manner than the second light source of the first plurality of light sources.

16. A system for detecting an object within a vicinity of a mining machine, the system comprising:

a sensor configured to secure to the mining machine;

a first plurality of light sources configured to secure to the mining machine; and an electronic processor configured to:

receive a signal from the sensor indicative of the object being positioned in the vicinity of the mining machine, determine that the position of the object corresponds to a first segment of a virtual perimeter extending at least partially around the mining machine, the first segment associated with the first plurality of light sources, identify a first light source of the first plurality of light sources that is closest to the object, control the first light source to illuminate in a first manner, control a second light source of the first plurality of light sources to illuminate in a second manner, the second manner different than the first manner, receive a second signal from the sensor indicative of a second object being positioned in the vicinity of the mining machine, determine that the position of the second object corresponds to the first segment of the virtual perimeter, determine which of the first object and the second object is the closest object to the mining machine, determine which of the first plurality of light sources is closest light source to the closest object, and control, based in part on a position of the closest object relative to the closest light source, the closest light source to illuminate in accordance with at least one of a particular color, a particular intensity, or a particular frequency.

17. The system of claim 16, wherein the first light source is secured at a first location on the mining machine and the second light source is secured at a second location on the mining machine, wherein the first location is different than the second location.

18. The system of claim 16, wherein the first light source is secured on a first surface of the mining machine and the second light source is secured on a second surface of the mining machine.

19. A method for detecting an object within a vicinity of a mining machine, the method comprising:

receiving, by an electronic processor, a signal from a sensor indicative of the object being positioned in the vicinity of the mining machine;

determining, by the electronic processor, that the position of the object corresponds to a first segment of a virtual perimeter extending at least partially around the mining machine, the first segment associated with the first plurality of light sources;

identifying, by the electronic processor, a first light source of the first plurality of light sources that is closest to the object;

controlling, by the electronic processor, the first light source to illuminate in a first manner;

controlling, by the electronic processor, a second light source of the first plurality of light sources to illuminate in a second manner, the second manner different than the first manner;

receiving a second signal from the sensor indicative of a second object being positioned in the vicinity of the mining machine;

determining that the position of the second object corresponds to the first segment of the virtual perimeter;

determining which of the first object and the second object is the closest object to the mining machine;

determining which of the first plurality of light sources is closest light source to the closest object; and controlling, based in part on a position of the closest object relative to the closest light source, the closest light source to illuminate in accordance with at least one of a particular color, a particular intensity, or a particular frequency.

20. The method of claim 19, wherein the first light source is secured at a first location on the mining machine and the second light source is secured at a second location on the mining machine, wherein the first location is different than the second location.

* * * * *